US010730289B2

(12) United States Patent
Suzuki

(10) Patent No.: US 10,730,289 B2
(45) Date of Patent: Aug. 4, 2020

(54) LIQUID EJECTING APPARATUS

(71) Applicant: SEIKO EPSON CORPORATION, Tokyo (JP)

(72) Inventor: Toshiyuki Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/232,100

(22) Filed: Dec. 26, 2018

(65) Prior Publication Data

US 2019/0193394 A1 Jun. 27, 2019

(30) Foreign Application Priority Data

Dec. 27, 2017 (JP) ..... 2017-252090

(51) Int. Cl.
*B41J 2/045* (2006.01)

(52) U.S. Cl.
CPC ..... *B41J 2/04563* (2013.01); *B41J 2/0451* (2013.01); *B41J 2/0459* (2013.01); *B41J 2/04541* (2013.01); *B41J 2/04551* (2013.01); *B41J 2/04573* (2013.01); *B41J 2/04581* (2013.01); *B41J 2/04586* (2013.01); *B41J 2/04588* (2013.01); *B41J 2/04591* (2013.01); *B41J 2/04593* (2013.01)

(58) Field of Classification Search
CPC .... B41J 2/1618; B41J 2/1623; B41J 2/04581; B41J 2/04588; B41J 2/04593; B41J 2/0451; B41J 2/04563; B41J 2/04541; B41J 2/04551; B41J 2/04573; B41J 2/04586; B41J 2/0459; B41J 2/04591
See application file for complete search history.

(56) References Cited

U.S. PATENT DOCUMENTS

2007/0046704 A1 3/2007 Okuda
2015/0097885 A1* 4/2015 Hosokawa ..... B41J 2/04541 347/10
2016/0375683 A1 12/2016 Veenstra et al.

FOREIGN PATENT DOCUMENTS

JP 2017-149077 A 8/2017

* cited by examiner

*Primary Examiner* — Thinh H Nguyen
(74) *Attorney, Agent, or Firm* — Global IP Counselors, LLP

(57) ABSTRACT

A liquid ejecting apparatus includes an ejection unit that ejects a liquid by a piezoelectric element being driven, a drive signal generation unit that generates a drive signal for driving the piezoelectric element, a residual vibration detection unit that detects a residual vibration of the ejection unit after the drive signal is applied to the piezoelectric element, and an inspection control signal generation unit that generates an inspection control signal for instructing start of detection of the residual vibration by the residual vibration detection unit. The inspection control signal when a temperature of the ejection unit is a first temperature differs from the inspection control signal when the temperature of the ejection unit is a second temperature lower than the first temperature.

8 Claims, 23 Drawing Sheets

1
20
600
60
VOUT
SI1
SI2
SI3
SI4
70, 70-1
70, 70-2
70, 70-3
70, 70-4
SWITCHING CIRCUIT
PO1
PO2
PO3
PO4
INSPECTION CIRCUIT
80, 80-1
80, 80-2
80, 80-3
80, 80-4
RS1
RS2
RS3
RS4
RESIDUAL VIBRATION DETECTION UNIT
120
90
TEMPERATURE SENSOR
VTEMP
190
100
110
DRIVE SIGNAL GENERATION UNIT
COMA-1
COMB-1
COMA-2
COMB-2
COMA-3
COMB-3
COMA-4
COMB-4
50, 50a-1
50, 50b-1
50, 50a-2
50, 50b-2
50, 50a-3
50, 50b-3
50, 50a-4
50, 50b-4
DRIVE CIRCUIT
VHV
VDD, GND
VBS
112
POWER SUPPLY CIRCUIT
SI1 TO SI4
SCK, LAT, CH
TSIG
HOST COMPUTER
dA1
dB1
dA2
dB2
dA3
dB3
dA4
dB4
CONTROL UNIT
111

| (SIH, SIM, SIL) | Sa | | Sb | | | Sc | | |
|---|---|---|---|---|---|---|---|---|
| | T1 | T2 | TS1 | TS2 | TS3 | TS1 | TS2 | TS3 |
| (1, 1, 0) [LARGE DOT] | H | H | L | L | L | L | L | L |
| (1, 0, 0) [MEDIUM DOT] | H | L | L | L | L | L | L | L |
| (0, 1, 0) [SMALL DOT] | L | H | L | L | L | L | L | L |
| (0, 0, 0) [NON-RECORD] | L | L | L | L | L | L | L | L |
| (1, 1, 1) [INSPECTION] | L | L | H | L | H | L | H | L |

FIG. 13

| | | | |
|---|---|---|---|
| Tp1 < Tth1 | - | - | RS = 2 [EJECTION ABNORMALITY (AIR BUBBLE)] |
| Tp1 ≥ Tth1 | Ap = 1 | Tp2 < Tth2 | RS = 2 [EJECTION ABNORMALITY (AIR BUBBLE)] |
| | | Tth2 ≤ Tp2 ≤ Tth3 | RS = 1 [NORMAL] |
| | | Tth3 < Tp2 ≤ Tth4 | RS = 3 [EJECTION ABNORMALITY (FOREIGN MATTER)] |
| | | Tth4 < Tp2 | RS = 4 [EJECTION ABNORMALITY (THICKENING)] |
| | Ap = 0 | - | RS = 5 [EJECTION ABNORMALITY] |

LIQUID EJECTING APPARATUS

This application claims priority to Japanese Patent Application No. 2017-252090 filed on Dec. 27, 2017. The entire disclosure of Japanese Patent Application No. 2017-252090 is hereby incorporated herein by reference.

BACKGROUND

1. Technical Field

The present invention relates to a liquid ejecting apparatus.

2. Related Art

It is known that a liquid ejecting apparatus, such as an ink jet printer which ejects ink to print an image or a document, uses a piezoelectric element (for example, a piezo element). The piezoelectric element is provided corresponding to each of a plurality of ejection units in a head (ink jet head), each piezoelectric element is driven according to a drive signal, and thereby a predetermined amount of ink (liquid) is ejected from nozzles of an ejection unit at a predetermined timing to form dots on a medium such as paper.

There is a case where ejection abnormality that ink cannot be ejected normally from an ejection unit due to thickening of the ink filled in the ejection unit, mixing of bubbles into the ejection unit, or the like occurs in the liquid ejecting apparatus. If the ejection abnormality occurs, the dots to be formed on the medium are not formed accurately, and an image quality is decreased. A technique is known in the related art which detects vibration (hereinafter, referred to as "residual vibration") remaining in the ejection unit after the ejection unit is driven and determines an ink ejection state in the ejection unit based on the detection result. Since a degree of the residual vibration differs depending on viscosity of the ink and the viscosity of the ink differs depending on a type (color) thereof, JP-A-2017-149077 discloses a print apparatus that sets an amplification factor of the residual vibration for each type of the ink and determines an ejection state of the ink in the ejection unit based on a signal in which the residual vibration is amplified.

However, since the viscosity of the ink also changes depending on a change in temperature (temperature of the ink) of the ejection unit, a method described in JP-A-2017-149077 has to change the setting of the amplification factor of the residual vibration or to change a determination criterion of an ejection state in accordance with a temperature change of the ejection unit so as to maintain a determination accuracy of the ejection state regardless of the temperature of the ejection unit, and thus, an inspection sequence from detection of the residual vibration to determination of the ejection state may be complicated in some cases.

SUMMARY

An advantage of some aspects of the invention is to provide a liquid ejecting apparatus which can simplify an inspection sequence until an ejection state is determined from detection of residual vibration.

The invention can be realized in the following aspects or application examples.

Application Example 1

According to this application example, there is provided a liquid ejecting apparatus including an ejection unit that ejects a liquid by a piezoelectric element being driven, a drive signal generation unit that generates a drive signal for driving the piezoelectric element, a residual vibration detection unit that detects a residual vibration of the ejection unit after the drive signal is applied to the piezoelectric element, and an inspection control signal generation unit that generates an inspection control signal for instructing start of detection of the residual vibration by the residual vibration detection unit, in which the inspection control signal when a temperature of the ejection unit is a first temperature differs from the inspection control signal when the temperature of the ejection unit is a second temperature lower than the first temperature.

In this case, an inspection control signal for instructing start of detection of a residual vibration is different between when a temperature of an ejection unit is a first temperature and when the temperature of the ejection unit is a second temperature, and thereby, a time difference between the timing at which a residual vibration detection unit starts the detection of the residual vibration and the timing at which the residual vibration starts in the ejection unit can be made approximately equal between when the temperature of the ejection unit is the first temperature and when the temperature of the ejection unit is the second temperature. Thus, while a reference of the detection made by the residual vibration detection unit is kept constant, when the temperature of the ejection unit is the first temperature and when the temperature of the ejection unit is the second temperature, the detection results of a phase and a cycle of the residual vibration detected by the residual vibration detection unit are approximately the same, and thus, determination criteria in the determination of an ejection state based on the phase and the cycle of the residual vibration can be the same, and an inspection sequence can be simplified.

Application Example 2

In the liquid ejecting apparatus according to the application example, there is provided a liquid ejecting apparatus including an ejection unit that ejects a liquid by a piezoelectric element being driven, a drive signal generation unit that generates a drive signal for driving the piezoelectric element, a residual vibration detection unit that detects a residual vibration of the ejection unit after the drive signal is applied to the piezoelectric element, and an inspection control signal generation unit that generates an inspection control signal for instructing start of detection of the residual vibration by the residual vibration detection unit, in which the drive signal when a temperature of the ejection unit is a first temperature differs from the drive signal when the temperature of the ejection unit is a second temperature lower than the first temperature.

In this case, a drive signal for detecting a residual vibration is different between when a temperature of an ejection unit is a first temperature and when the temperature of the ejection unit is a second temperature, and thereby, an amplitude of a signal of detection results of the residual vibration by the residual vibration detection unit can be made approximately equal between when the temperature of the ejection unit is the first temperature and the temperature of the ejection unit is the second temperature. Thus, the detection results of the amplitude of the residual vibration by the residual vibration detection unit are approximately the same between when the temperature of the ejection unit is the first temperature and when the temperature of the ejection unit is the second temperature, and thereby, the determination criteria in the determination of an ejection state based on the amplitude of the residual vibration can be the same and the inspection sequence can be simplified.

Application Example 3

In the liquid ejecting apparatus according to the application example, an amplitude of the drive signal when the temperature of the ejection unit is the first temperature may be smaller than an amplitude of the drive signal when the temperature of the ejection unit is the second temperature.

For example, "the amplitude of the drive signal" is a difference between a maximum potential and a minimum potential of the drive signal.

In this case, when a temperature of an ejection unit is a first temperature, a viscosity of a liquid filled in the ejection unit is lower than the viscosity when the temperature of the ejection unit is a second temperature, and thereby, when the temperature of the ejection unit is the first temperature, an amplitude of a drive signal is smaller than the amplitude when the temperature of the ejection unit is the second temperature, and thus, an amplitude of a residual vibration can be made approximately equal between when the temperature of the ejection unit is the first temperature and when the temperature of the ejection unit is the second temperature. Therefore, when the temperature of the ejection unit is the first temperature and when the temperature of the ejection unit is the second temperature, detection results of the amplitude of the residual vibration detected by the residual vibration detection unit are approximately the same, and thus, determination criteria in determining the ejection state based on the amplitude of the residual vibration can be the same, and an inspection sequence can be simplified.

Application Example 4

In the liquid ejecting apparatus according to the application example, an instruction to start detection by the inspection control signal when the temperature of the ejection unit is the first temperature may be executed earlier than an instruction to start detection by the inspection control signal when the temperature of the ejection unit is the second temperature.

In this case, when a temperature of an ejection unit is a first temperature, an amplitude of a drive signal is smaller than an amplitude when the temperature of the ejection unit is a second temperature, and thereby, the timing at which the residual vibration starts in the ejection unit is earlier. Accordingly, when the temperature of the ejection unit is the first temperature, an instruction to start detection of the residual vibration is executed earlier than the instruction when the temperature of the ejection unit is the second temperature, and thereby, a time difference between the timing at which the residual vibration detection unit starts the detection of the residual vibration and the timing at which the residual vibration starts in the ejection unit can be made approximately equal between when the temperature of the ejection unit is the first temperature and when the temperature of the ejection unit is the second temperature. Thus, when the temperature of the ejection unit is the first temperature and when the temperature of the ejection unit is the second temperature, detection results of a phase and a cycle of the residual vibration detected by the residual vibration detection unit are substantially the same, and thus, determination criteria in determining the ejection state based on the phase and the cycle of the residual vibration can be the same and an inspection sequence can be further simplified.

Application Example 5

In the liquid ejecting apparatus according to the application example, the inspection control signal may further instruct end of the detection of the residual vibration, and an instruction to end the detection by the inspection control signal when the temperature of the ejection unit is the first temperature may be executed earlier than an instruction to end the detection by the inspection control signal when the temperature of the ejection unit is the second temperature.

In this case, an instruction to end detection of a residual vibration is the same as an instruction to start the detection of the residual vibration, and is executed earlier when a temperature of an ejection unit is a first temperature than when the temperature of the ejection unit is a second temperature, and thus, a period in which a residual vibration detection unit detects the residual vibration can be made approximately equal to the periods between when the temperature of the ejection unit is the first temperature and when the temperature of the ejection unit is the second temperature.

Application Example 6

In the liquid ejecting apparatus according to the application example, the drive signal when the temperature of the ejection unit is the first temperature may be the same as the drive signal when the temperature of the ejection unit is the second temperature, and an instruction to start detection by the inspection control signal when the temperature of the ejection unit is the first temperature may be executed later than an instruction to start detection by the inspection control signal when the temperature of the ejection unit is the second temperature.

"Drive signals are equal" includes not only a case where the drive signals are exactly the same but also a case where the drive signals are substantially the same, and also includes, for example, a case where the drive signals have a difference as long as the same determination criterion can be used in determining an ejection state of the ejection unit based on the detection results of the residual vibration detected by the residual vibration detection unit.

In this case, drive signals are the same when a temperature of an ejection unit is a first temperature and when the temperature of the ejection unit is a second temperature, and thus, an amplitude of a residual vibration at the time of the first temperature is larger than the amplitude at the time of the second temperature. Accordingly, if a first wave of the residual vibration is detected, a signal is easily distorted due to a saturation of a voltage level or the like. When the temperature of the ejection unit is the first temperature, an instruction to start detection of the residual vibration is performed later than when the temperature of the ejection unit is the second temperature, and thus, the second and subsequent waves of the residual vibration can be detected, and a possibility that a determination accuracy based on the signal of detection result decreases is reduced.

Application Example 7

In the liquid ejecting apparatus according to the application example, the inspection control signal may further instruct end of the detection of the residual vibration, and the instruction to end the detection by the inspection control signal when the temperature of the ejection unit is the first temperature may be executed later than the instruction to end the detection by the inspection control signal when the temperature of the ejection unit is the second temperature.

In this case, when a temperature of an ejection unit is a first temperature, an instruction to end detection of a residual vibration is executed later than the instruction when the temperature of the ejection unit is a second temperature, in the same manner as the instruction to start the detection of the residual vibration, and thus, a period in which a residual vibration detection unit detects the residual vibration can be made approximately the same when the temperature of the ejection unit is the first temperature and when the temperature of the ejection unit is the second temperature.

Application Example 8

In the liquid ejecting apparatus according to the application example, the residual vibration when the temperature of the ejection unit is the first temperature may be equal to the residual vibration when the temperature of the ejection unit is the second temperature.

"Residual vibrations are the same" includes not only a case where the residual vibrations are exactly the same but also a case where the residual vibrations are substantially the same, and also includes, for example, a case where the residual vibrations have a difference as long as it is possible to use the same determination criterion in determining an ejection state of the ejection unit based on detection results of the residual vibration detected by the residual vibration detection unit.

In this case, with respect to an inspection control signal for instructing start of detection of a residual vibration, when a temperature of an ejection unit is a first temperature, the residual vibration is the same as the residual vibration when the temperature of the ejection unit is a second temperature, and thus, detection results of the residual vibration detected by a residual vibration detection unit can be made approximately the same when the temperatures of the ejection unit is the first temperature and when the temperatures of the ejection unit is the second temperature. Thus, determination criteria in determining an ejection state based on the detection results of the residual vibration can be the same when the temperature of the ejection unit is the first temperature and when the temperature of the ejection unit is the second temperature, and an inspection sequence can be simplified.

BRIEF DESCRIPTION OF THE DRAWINGS

The invention will be described with reference to the accompanying drawings, wherein like numbers reference like elements.

FIG. 13 is a diagram illustrating an example of determination logic by a determination unit.

DESCRIPTION OF EXEMPLARY EMBODIMENTS

Hereinafter, embodiments of the invention will be described in detail with reference to the drawings. The drawings used are for the sake of convenient explanation. The embodiments which will be described below do not unduly limit content of the invention described in the claims. In addition, all the configurations which will be described below are not essential configuration requirements of the invention.

1. First Embodiment

1-1. Outline of Liquid Ejecting Apparatus

A print apparatus which is an example of a liquid ejecting apparatus according to the present embodiment is an ink jet printer that forms an ink dot group on a print medium such as paper by ejecting ink in accordance with image data supplied from an external host computer, thereby, printing an image (including a letter, a figure or the like) in accordance with the image data.

Figure 1:
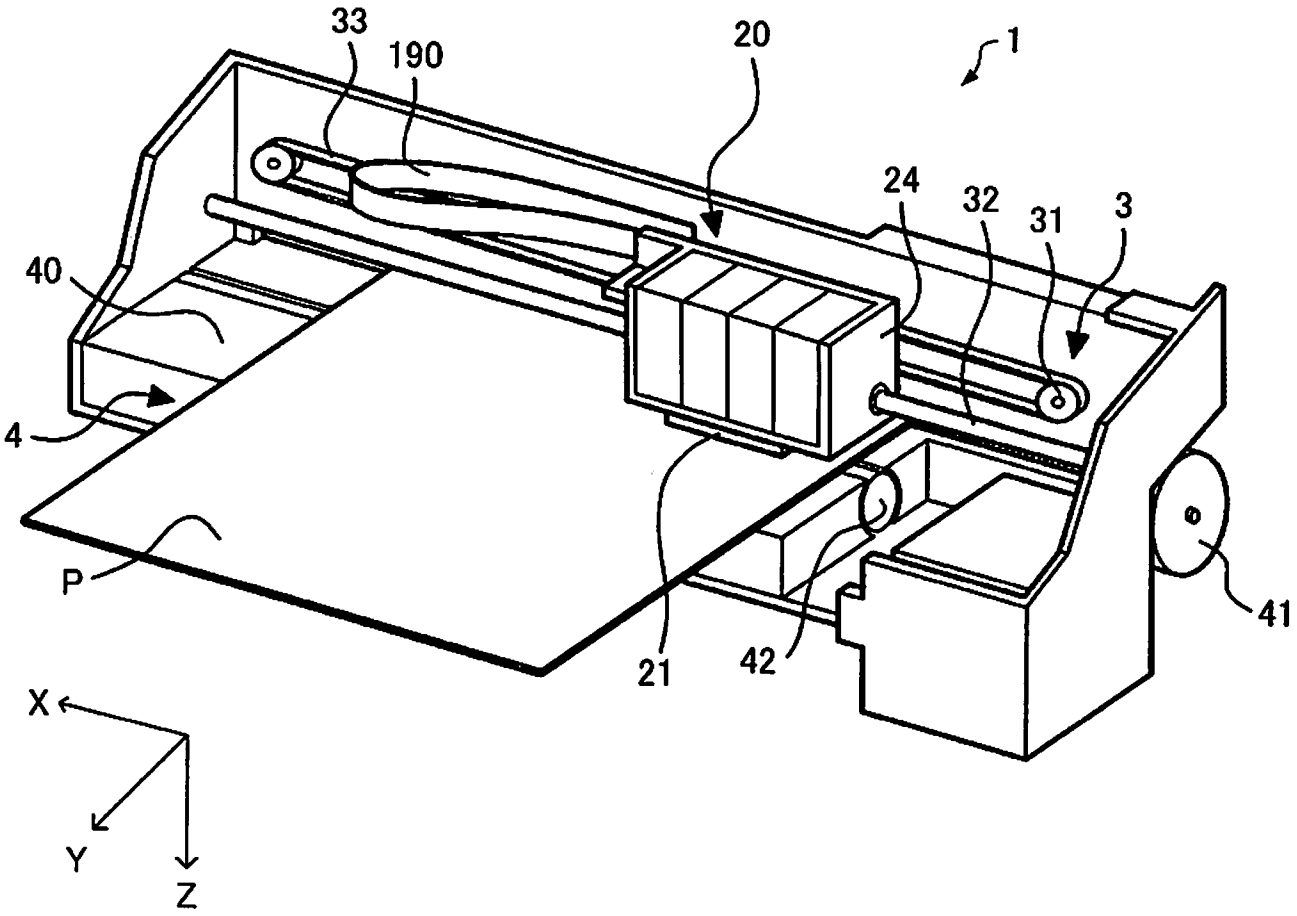
FIG. 1 is a view illustrating a schematic configuration of a liquid ejecting apparatus.

FIG. 1 is a perspective view illustrating a schematic internal configuration of a liquid ejecting apparatus 1 according to the present embodiment. As illustrated in FIG. 1, the liquid ejecting apparatus 1 is a serial scan type (serial print type) liquid ejecting apparatus, and includes a head unit 20 and a movement mechanism 3 (reciprocating) that moves the head unit 20 in a main scan direction X. Although not illustrated, a USB port and a power supply port are provided on a rear surface of the liquid ejecting apparatus 1. That is, the liquid ejecting apparatus 1 is configured to be able to be connected to a computer or the like via the USB port. In the liquid ejecting apparatus 1 according to the present embodiment, a movement direction of a carriage 24 is defined as the main scan direction X, a transportation direction of a print medium P is defined as a sub-scan direction Y, and a vertical direction is defined as Z. The main scan direction X, the sub-scan direction Y, and the vertical direction Z are denoted in the drawings as three axes orthogonal to each other, and an arrangement relationship between the respective configuration elements is not necessarily limited to the directions orthogonal to each other.

The movement mechanism 3 includes a carriage motor 31 serving as a drive source of the head unit 20, a carriage guide shaft 32 fixed to both ends, and a timing belt 33 that extends substantially in parallel with the carriage guide shaft 32 and is driven by the carriage motor 31.

The head unit 20 includes the carriage 24 and a head 21 mounted on the carriage 24 so as to face the print medium P. The carriage 24 is supported by the carriage guide shaft 32 so as to be reciprocatable and is fixed to a part of the timing belt 33. Accordingly, if the timing belt 33 is caused to move in forward and reverse directions by the carriage motor 31, the head unit 20 reciprocates while being guided by the carriage guide shaft 32. The head 21 is configured to eject ink droplets (liquid droplets) from many nozzles and to supply various control signals and the like via a cable 190. The cable 190 may be, for example, a flexible flat cable (FFC).

Figure 2:
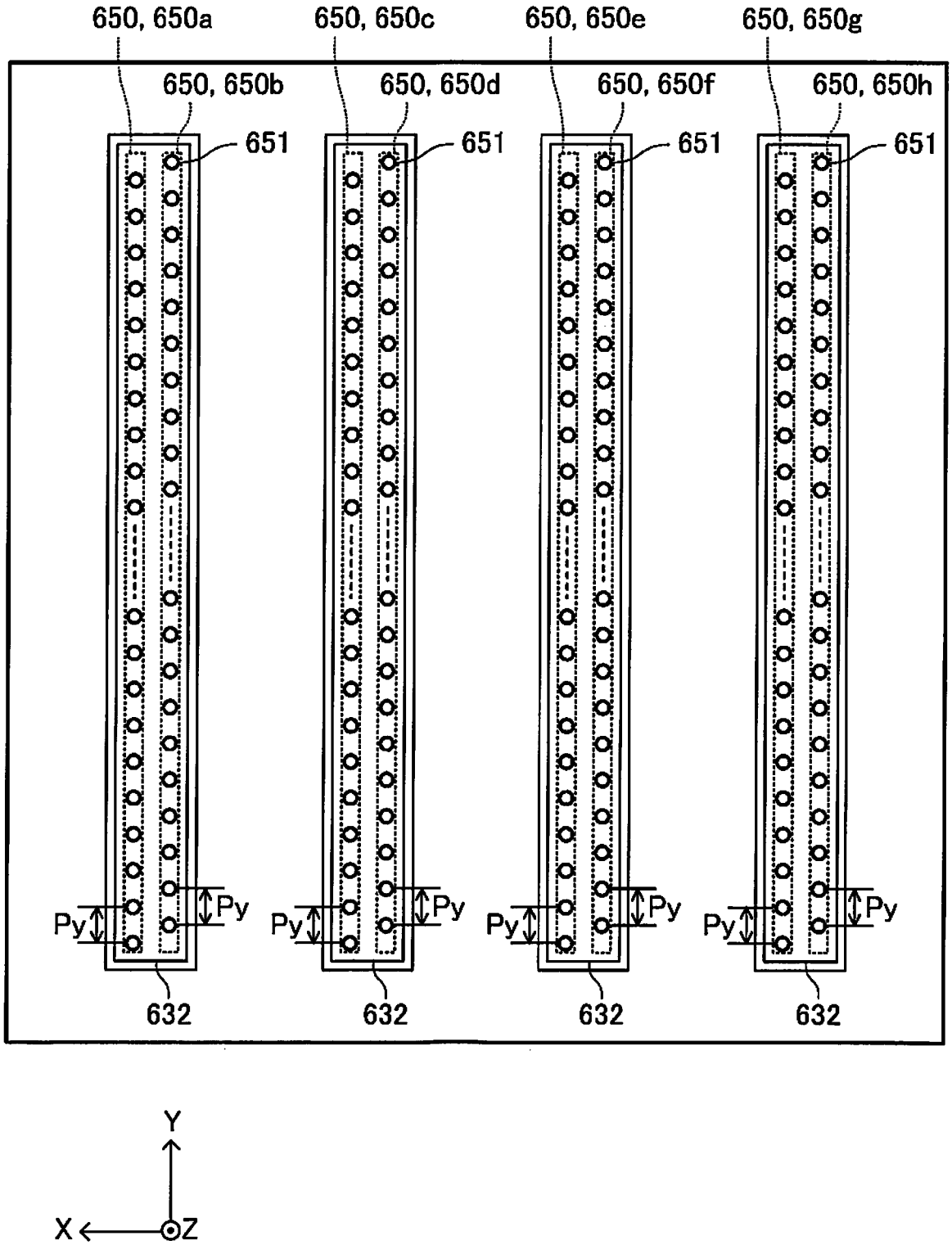
FIG. 2 is a view illustrating a lower surface (ink ejection surface) of a head.

FIG. 2 is a view illustrating a lower surface (ink ejection surface) of the head 21. As illustrated in FIG. 2, four nozzle plates 632, each having two nozzle arrays 650 in which many nozzles 651 are arranged at a predetermined pitch Py in the sub-scan direction Y, are provided side by side in the main scan direction X on the ink ejection surface of the head 21. The respective nozzles 651 are shifted by half of the pitch Py in the sub-scan direction Y between the two nozzle arrays 650 provided in the respective nozzle plates 632. In this way, in the present embodiment, eight nozzle arrays 650 (a first nozzle array 650*a* to an eighth nozzle array 650*h*) are provided on the ink ejection surface of the head 21.

As illustrated in FIG. 1, the liquid ejecting apparatus 1 further includes a transport mechanism 4 that transports the print medium P onto a platen 40 in the sub-scan direction Y. The transport mechanism 4 includes a transport motor 41 which is a drive source, and a transport roller 42 that is rotated by the transport motor 41 and transports the print medium P in the sub-scan direction Y.

In the present embodiment, four ink cartridges 22 are stored in the carriage 24, and the ink filled in each ink cartridge 22 is supplied to the head 21. For example, four ink cartridges 22 are filled with inks of four colors (CMYK) of cyan, magenta, yellow, and black, respectively. The respective ink cartridges 22 are provided in an ink tank attached to a main body side without being mounted on the carriage 24, and the ink filled in each ink cartridge 22 may be supplied to the head 21 via an ink tube.

As the head 21 ejects the ink droplets in the vertical direction Z (vertically downward) toward the print medium P at the timing when the print medium P is transported by the transport mechanism 4, an image is formed on a surface of the print medium P.

1-2. Electrical Configuration of Liquid Ejecting Apparatus

Figure 3:
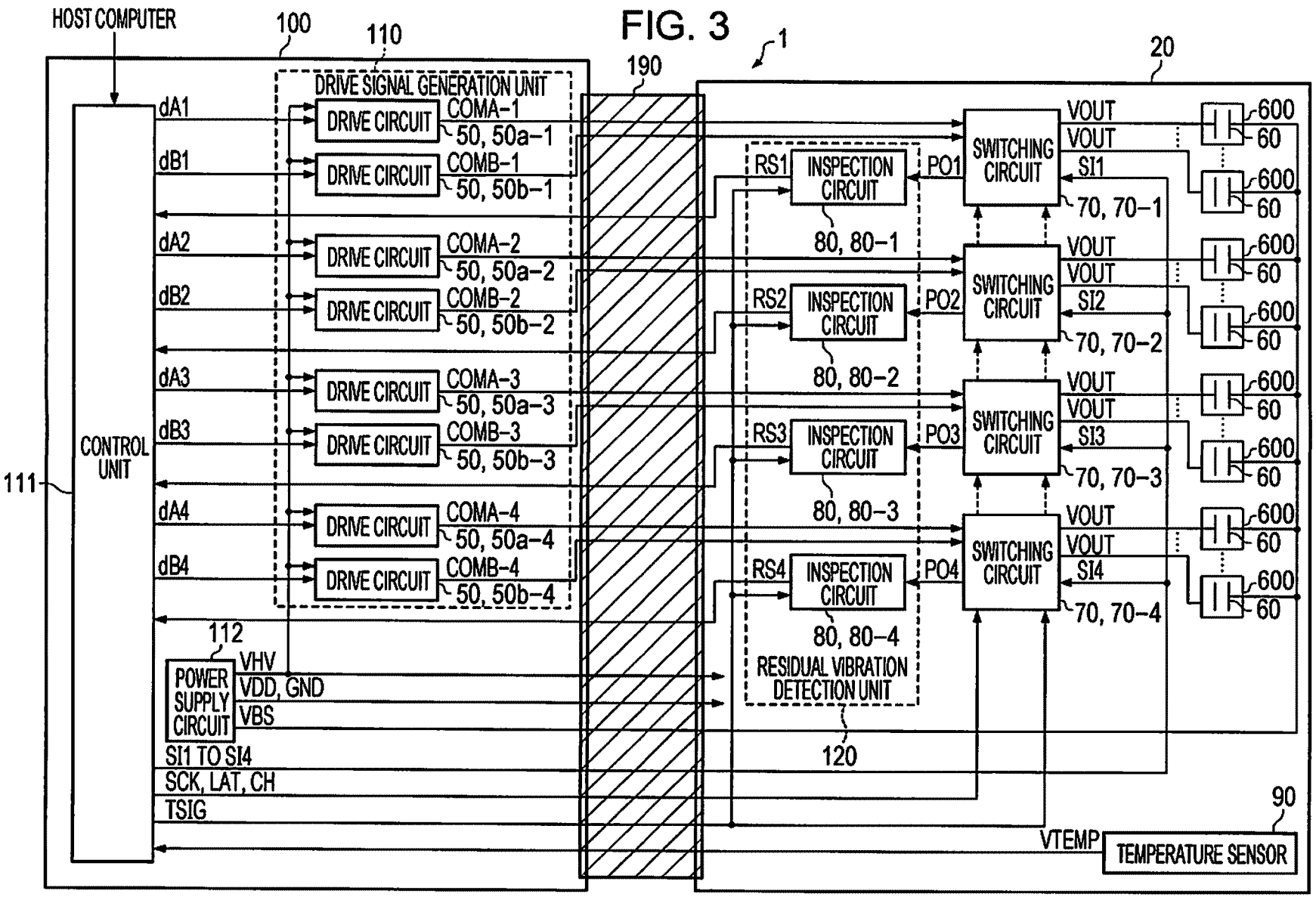
FIG. 3 is a block diagram illustrating an electrical configuration of the liquid ejecting apparatus.

FIG. 3 is a block diagram illustrating an electrical configuration of the liquid ejecting apparatus 1 according to the present embodiment. As illustrated in FIG. 3, the liquid ejecting apparatus 1 includes a control substrate 100 and the head unit 20. The control substrate 100 is fixed at a predetermined location inside a main body of the liquid ejecting apparatus 1 and is connected to the head unit 20 by the cable 190.

A control unit 111, a power supply circuit 112, and eight drive circuits 50 (50*a*-1 to 50*a*-4 and 50*b*-1 to 50*b*-4) are provided (mounted) on the control substrate 100.

The control unit 111 is realized by a processor such as a microcontroller and generates various data and signals, based on various signals such as image data supplied from a host computer.

Specifically, the control unit 111 generates drive data dA1 to dA4 and dB1 to dB4 that are digital data which is a basis of the drive signals COMA-1 to COMA-4 and COMB-1 to COMB-4 for driving the respective ejection units 600 included in the head 21, based on various signals from the host computer, respectively. The drive data dA1 to dA4 is supplied to the drive circuits 50*a*-1 to 50*a*-4, respectively, and the drive data dB1 to dB4 is supplied to the drive circuits 50*b*-1 to 50*b*-4, respectively. The drive data dA1 to dA4 is digital data that respectively define waveforms of the drive signals COMA-1 to COMA-4, and the drive data dB1 to dB4 is digital data that respectively define waveforms of the drive signals COMB-1 to COMB-4.

In addition, the control unit 111 generates four print data signals SI1 to SI4, a latch signal LAT, a change signal CH, and a clock signal SCK as a plurality of types of control signals for controlling ejection of a liquid from each ejection unit 600, based on various signals from the host computer. In addition, the control unit 111 generates an inspection control signal TSIG for instructing start of detection of the residual vibration remaining in the ejection unit 600 and ended after the ejection unit 600 is driven. The print data signals SI1 to SI4, the latch signal LAT, the change signal CH, the clock signal SCK, and the inspection control signal TSIG are transmitted from the control unit 111 to the head unit 20 via the cable 190.

In addition to the above processing, the control unit 111 grasps a scan location (current location) of the head unit 20 (carriage 24) and drives the carriage motor 31 based on the scan location of the head unit 20. Thereby, movement of the head unit 20 in the main scan direction X is controlled. In addition, the control unit 111 drives the transport motor 41. Thereby, movement of the print medium P in the sub-scan direction Y is controlled.

Furthermore, the control unit 111 causes a maintenance mechanism (not illustrated) to perform maintenance processing (cleaning processing (pumping processing) or wiping processing) for normally recovering the ink ejection state of the head 21.

The power supply circuit 112 generates a constant high power supply voltage VHV (for example, 42 V), a constant low supply voltage VDD (for example, 3.3 V), a constant offset voltage VBS (for example, 6 V), and a ground voltage GND (0 V). The high power supply voltage VHV, the low power supply voltage VDD, the offset voltage VBS, and the ground voltage GND are transmitted from the power supply circuit 112 to the head unit 20 via the cable 190. The high power supply voltage VHV, the low power supply voltage VDD, and the ground voltage GND are supplied to the drive circuits 50*a*-1 to 50*a*-4 and 50*b*-1 to 50*b*-4, respectively.

The drive circuits 50*a*-1 to 50*a*-4 and 50*b*-1 to 50*b*-4 generate the drive signals COMA-1 to COMA-4 and COMA-4, COMB-1 to COMB-4 for driving the ejection unit 600 (piezoelectric element 60), based on the drive data dA1 to dA4 and dB1 to dB4, respectively. For example, the drive circuits 50*a*-1 to 50*a*-4 and 50*b*-1 to 50*b*-4 perform digital-to-analog conversion of the drive data dA1 to dA4 and dB1 to dB4, respectively, and thereafter, perform a class-D amplification, thereby, generating the drive signals COMA-1 to COMA-4 and COMB-1 to COMB-4. The drive data dA1 to dA4 and dB1 to dB4 are data for defining the waveforms of the drive signals COMA-1 to COMA-4 and COMB-1 to COMB-4, respectively. The drive circuits 50*a*-1 to 50*a*-4 and 50*b*-1 to 50*b*-4 differ only in the data to be input and the drive signal to be output, and circuit configurations thereof may be the same.

The drive signals COMA-1 to COMA-4 and COMB-1 to COMB-4 are transmitted from the control substrate 100 to the head unit 20 via the cable 190.

Four switching circuits 70 (70-1 to 70-4), four inspection circuits 80 (80-1 to 80-4), and a temperature sensor 90 are provided (built) in the head unit 20.

The switching circuits 70-1 to 70-4 receive the drive signals COMA-1 to COMA-4, the drive signals COMB-1 to COMB-4, and the print data signals SI1 to SI4, respectively. In addition, the switching circuits 70-1 to 70-4 commonly receive the clock signal SCK, the latch signal LAT, the change signal CH, and the inspection control signal TSIG. The switching circuits 70-1 to 70-4 operate by being supplied with the high power supply voltage VHV, the low power supply voltage VDD, and the ground voltage GND, and output drive signals VOUT to the plurality of ejection units 600 included in the head 21, respectively. Specifically, the switching circuit 70-1 selects either the drive signal COMA-1 or the drive signal COMB-1, based on the clock signal SCK, the print data signal SI1, the latch signal LAT, the change signal CH, and the inspection control signal TSIG, and outputs the selected signal as the drive signal VOUT, or makes an output a high impedance without selecting either. Likewise, the switching circuits 70-2 to 70-4 select the drive signals COMA-2 to COMA-4 and the drive signals COMB-2 to COMB-4, respectively, based on the clock signal SCK, each of the print data signals SI2 to SI4, the latch signal LAT, the change signal CH, and the inspection control signal TSIG and outputs the selected signals as the drive signals VOUT, or make outputs high impedances without selecting either.

The drive signal VOUT output from the switching circuit 70-1 is applied to one end of the piezoelectric element 60 included in each of the ejection units 600 provided corresponding to the first nozzle array 650*a* and a second nozzle array 650*b*. The drive signal VOUT output from the switching circuit 70-2 is applied to one end of the piezoelectric element 60 included in each of the ejection units 600 provided corresponding to a third nozzle array 650*c* and a fourth nozzle array 650*d*. The drive signal VOUT output from the switching circuit 70-3 is applied to one end of the piezoelectric element 60 included in each the ejection units 600 provided corresponding to a fifth nozzle array 650*e* and a sixth nozzle array 650*f*. The drive signal VOUT output from the switching circuit 70-4 is applied to one end of the piezoelectric element 60 included in each of the ejection units 600 provided corresponding to a seventh nozzle array 650*g* and an eighth nozzle array 650*h*. The offset voltage VBS is commonly applied to the other end of each of the piezoelectric elements 60. Then, the piezoelectric element 60 is displaced according to a potential difference between the drive signal VOUT and the offset voltage VBS, and ejects a liquid (ink) of the amount corresponding to the displacement from the nozzle 651. Alternatively, the piezoelectric element 60 is displaced according to a potential difference between the drive signal VOUT and the offset voltage VBS, and vibration (residual vibration) occurs in the ejection unit 600 without ejection of the liquid (ink) from the nozzle 651.

In addition, the switching circuit 70-1 selects whether or not to connect one end of the piezoelectric element 60 included in each of the ejection units 600 provided corresponding to the first nozzle array 650*a* or the second nozzle array 650*b* to the inspection circuit 80-1, based on the print data signal SI1 and the inspection control signal TSIG. Likewise, the switching circuit 70-2 selects whether or not to connect one end of the piezoelectric elements 60 included in each of the ejection units 600 provided corresponding to the third nozzle array 650*c* or the fourth nozzle array 650*d* to the inspection circuit 80-2, based on the print data signal SI2 and the inspection control signal TSIG. Likewise, the switching circuit 70-3 selects whether or not to connect one end of the piezoelectric element 60 included in each of the ejection units 600 provided corresponding to the fifth nozzle array 650*e* or the sixth nozzle array 650*f* to the inspection circuit 80-3, based on the print data signal SI3 and the inspection control signal TSIG. Likewise, the switching circuit 70-4 selects whether or not to connect one end of the piezoelectric element 60 included in each of the ejection units 600 provided corresponding to the seventh nozzle array 650*g* or the eighth nozzle array 650*h* to the inspection circuit 80-4, based on the print data signal SI4 and the inspection control signal TSIG.

Specifically, the switching circuits 70-1 to 70-4 select the ejection unit 600 (hereinafter, referred to as "inspection target ejection unit 600") which becomes an inspection target in an ejection state, based on the respective print data signals SI1 to SI4, respectively, and electrically connect one end of each of the piezoelectric elements 60 included in the selected ejection units 600 to each of the inspection circuits 80-1 to 80-4, based on the inspection control signal TSIG, and electrically disconnect one end of each of the other piezoelectric elements 60 (the piezoelectric elements 60 included in the ejection units 600 which are not the inspection target) which are not selected from each of the inspection circuits 80-1 to 80-4. Then, in a state where one end of the piezoelectric element 60 included in each of the four ejection units 600 that are the inspection target is electrically connected to each of the inspection circuits 80-1 to 80-4, inspection target signals PO1 to PO4 appearing at each one end of the piezoelectric elements 60 included in the four ejection units 600 which are inspection targets are input to the inspection circuits 80-1 to 80-4, respectively.

The switching circuits 70-1 to 70-4 may have the same circuit configuration, and details thereof will be described below.

The inspection circuits 80-1 to 80-4 receive the inspection control signal TSIG and the inspection target signals PO1 to PO4, respectively, and operate by being supplied with the low power supply voltage VDD and the ground voltage GND. The inspection circuits 80-1 to 80-4 detect residual vibrations of the ejection units 600 after the drive signal VOUT is applied to the piezoelectric elements 60 included in the inspection target ejection unit 600, in synchronization with the inspection control signal TSIG and based on each of the inspection target signals PO1 to PO4. Furthermore, the inspection circuits 80-1 to 80-4 determine ejection states of the ink in the inspection target ejection units 600, based on the detection results of the residual vibration, and output determination result signals RS1 to RS4 representing the determination results, respectively. The determination result signals RS1 to RS4 are transmitted from the head unit 20 to the control unit 111 via the cable 190.

The control unit 111 performs processing according to the determination result signals RS1 to RS4. For example, in a case where at least one of the determination result signals RS1 to RS4 indicates that ejection abnormality occurs in the ejection unit 600, the control unit 111 may display an error message on a display (not illustrated) included in the liquid ejecting apparatus 1. For example, the control unit 111 may generate a control signal for causing a maintenance mechanism (not illustrated) to perform maintenance processing, or may generate the print data signals SI1 to S14 for performing supplementary recording processing of supplementing the recording (printing) on the print medium P by the ejection unit 600 having no ejection abnormality, instead of the ejection unit 600 having the ejection abnormality.

The temperature sensor 90 operates by being supplied with the low power supply voltage VDD and the ground voltage GND, detects a temperature of the head 21, and outputs a temperature signal VTEMP indicating the temperature of the head 21. For example, the temperature sensor 90 may be provided inside the head 21 or may be provided on an outer surface of the head 21. The temperature signal VTEMP is transmitted from the head unit 20 to the control unit 111 via the cable 190.

The control unit 111 generates the drive data dA1 to dA4 and dB1 to dB4 for correcting the drive signals COMA-1 to COMA-4 and COMB-1 to COMB-4, based on the temperature signal VTEMP. In the present embodiment, the drive signal VOUT for causing ink to be ejected from the respective ejection units 600 so as to print an image based on image data on the print medium P is generated based on the drive signals COMA-1 to COMA-4. Then, the control unit 111 changes the drive data dA1 to dA4 according to a value (a voltage level or a digital value) of the temperature signal VTEMP such that the amount of ink ejected from the respective ejection units 600 is constant irrespective of a temperature change. Specifically, as the temperature (ink temperature) of the ejection unit 600 is lower, viscosity of the ink becomes is higher, and thereby, ink is less likely to be ejected from the nozzle 651, and thus, the control unit 111 generates the drive data dA1 to dA4 such that, as the temperature (that is, the temperature of the head 21 indicated by the temperature signal VTEMP) of the ejection unit 600 is lower, amplitudes (the amount of potential change) of the drive signals COMA-1 to COMA-4 increase (In other words, such that the amplitudes of the drive signals COMA-1 to COMA-4 decrease as the temperature of the ejection unit 600 increases). Hereinafter, the term "temperature" simply indicates the temperature of the ejection unit 600.

In the present embodiment, the drive signal VOUT for generating the residual vibration in each ejection unit 600 when the ejection state of each ejection unit 600 is inspected is generated based on the drive signals COMB-1 to COMB-4. Then, the control unit 111 changes the drive data dB1 to dB4 according to a value of the temperature signal VTEMP such that a magnitude of the residual vibration generated in each ejection unit 600 is constant irrespective of the temperature. Specifically, the lower the temperature is, the higher the viscosity of the ink is and the more the residual vibration is reduced, and thus, the control unit 111 generate the drive data dB1 to dB4 such that the amplitudes of the drive signals COMB-1 to COMB-4 increase as the temperature decreases (in other words, such that the amplitudes of the drive signals COMB-1 to COMB-4 decrease as the temperature increases).

Although details will be described below, in the present embodiment, the control unit 111 changes the inspection control signal TSIG according to the value of the temperature signal VTEMP such that a phase of the residual vibration at the time of detection start of the residual vibration by the inspection circuits 80-1 to 80-4 is constant irrespective of the temperature.

In the present embodiment, the drive circuits 50*a*-1 to 50*a*-4 and 50*b*-1 to 50*b*-4 configure a drive signal generation unit 110 that generates the drive signals COMA-1 to COMA-4 and COMB-1 to COMB-4 for driving the piezoelectric element 60. The inspection circuits 80-1 to 80-4 configure a residual vibration detection unit 120 that detects the residual vibration of the ejection unit 600 after the drive signal COMB is applied to the piezoelectric element 60. The control unit 111 functions as an inspection control signal generation unit that generates the inspection control signal TSIG for instructing start and end of detection of the residual vibration made by the residual vibration detection unit 120.

1-3. Configuration of Ejection Unit

Figure 4:
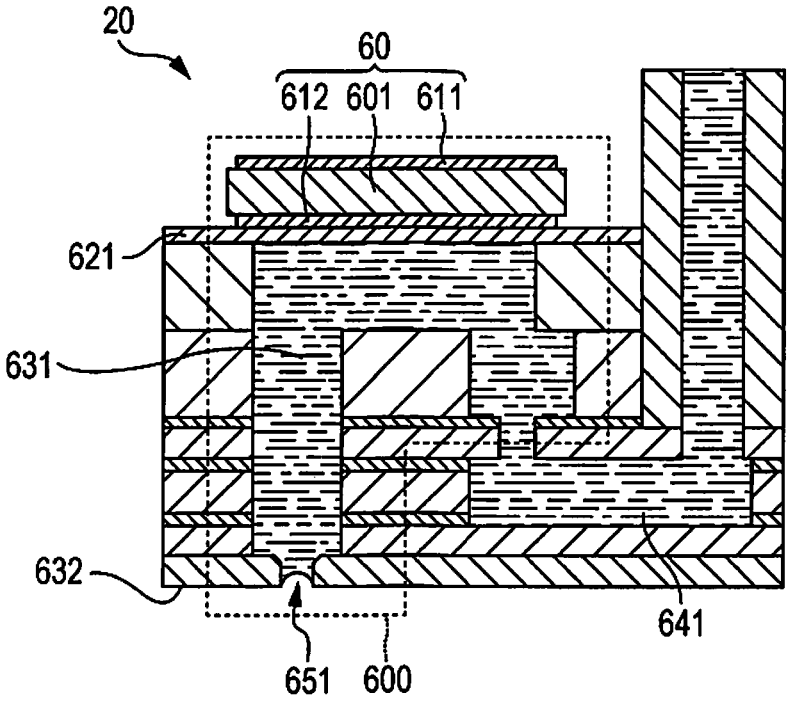
FIG. 4 is a diagram illustrating a schematic configuration corresponding to one ejection unit.

FIG. 4 is a diagram illustrating a schematic configuration corresponding to one ejection unit 600 included in the head 21. As illustrated in FIG. 4, the head 21 includes an ejection unit 600 and a reservoir 641.

The reservoir 641 is provided for each color of ink, and the ink is introduced into the reservoir 641 from a supply port 661. The ink is supplied from the ink cartridge 22 to the supply port 661.

The ejection unit 600 includes the piezoelectric element 60, a vibration plate 621, a cavity (pressure chamber) 631, and a nozzle 651. Among those, the vibration plate 621 functions as a diaphragm that is displaced (bending vibration) by the piezoelectric element 60 provided on an upper surface in the figure and enlarges/reduces an internal volume of the cavity 631 to be filled with the ink. The nozzle 651 is provided in a nozzle plate 632 and is an opening portion communicating with the cavity 631. The cavity 631 is filled with a liquid (for example, ink), and an internal volume thereof is changed by a displacement of the piezoelectric element 60. The nozzle 651 communicates with the cavity 631 and ejects the liquid in the cavity 631 as droplets in accordance with the change in the internal volume of the cavity 631. As such, the ejection unit 600 ejects the ink from the nozzle 651 by the piezoelectric element 60 being driven.

The piezoelectric element 60 illustrated in FIG. 4 has a structure in which a piezoelectric body 601 is sandwiched between a pair of electrodes 611 and 612. In the piezoelectric body 601 having this structure, a central portion in FIG. 4 is bent together with the electrodes 611 and 612 and the vibration plate 621 in the vertical direction with respect to both end portions according to voltages applied to the electrodes 611 and 612.

Specifically, the drive signal VOUT is applied to the electrode 611 which is one end of the piezoelectric element 60, and the offset voltage VBS is applied to the electrode 612 which is the other end of the piezoelectric element 60. Then, the piezoelectric element 60 is bent upward if the voltage of the drive signal VOUT decreases and is bent downward if the voltage of the drive signal VOUT increases. In this configuration, if the piezoelectric element is bent upward, the internal volume of the cavity 631 is expanded, and thereby, the ink is pulled from the reservoir 641, whereas if the piezoelectric element is bent downward, the internal volume of the cavity 631 is reduced, and thereby, the ink is ejected from the nozzle 651 depending on a degree of reduction.

The piezoelectric element 60 is not limited to the illustrated structure, and any type may be used as long as a liquid such as ink can be ejected by deforming the piezoelectric element 60. In addition, the piezoelectric element 60 is not limited to the bending vibration and may be configured to use a so-called longitudinal vibration.

In addition, the piezoelectric element 60 is provided corresponding to the cavity 631 and the nozzle 651 in the head 21, and is also provided corresponding to a selection circuit 230 (see FIG. 7) which will be described below. Accordingly, a set of the piezoelectric element 60, the cavity 631, the nozzle 651, and the selection circuit 230 is provided for each nozzle 651.

1-4. Configuration of Drive Signal

In the present embodiment, the drive signal COMA-1 is prepared to express four gradations of a "large dot", a "medium dot", a "small dot", and a "non-record (no dot)" with respect to one dot by using the liquid droplets ejected from the respective nozzles 651 included in the first nozzle array 650*a* or the second nozzle array 650*b*, and a first half pattern and a second half pattern are provided in one cycle of the drive signal COMA-1. The drive signal COMA-1 is selected (or not selected) in the first half and the second half of one cycle in accordance with the gradation to be expressed and is supplied to the piezoelectric element 60 provided corresponding to each nozzle 651. Furthermore, in the present embodiment, in order to perform "inspection" for the ejection unit 600 which is an inspection target among the ejection units 600 provided corresponding to the first nozzle array 650*a* or the second nozzle array 650*b*, a drive signal COMB-1 is also prepared separately from the drive signal COMA-1. In addition, in the present embodiment, the drive signals COMA-2 to COMA-4 are prepared for the same purpose as the drive signal COMA-1, and the drive signals COMB-2 to COMB-4 are prepared for the same purpose as the drive signal COMB-1.

Since the drive signals COMA-1 to COMA-4 differ in the type (cyan, magenta, yellow, and black) of ink to be ejected and basic configurations thereof are the same although the waveforms are somewhat different, the drive signals COMA-1 to COMA-4 are collectively referred to as a drive signal COMA, and the drive signal COMA will be illustrated and described hereinafter. Likewise, since the drive signals COMB-1 to COMB-4 somewhat differ in waveform and basic configurations thereof are the same, the drive signals COMB-1 to COMB-4 are collectively referred to as a drive signal COMB, and the drive signal COMB will be illustrated and described hereinafter.

Figure 5:
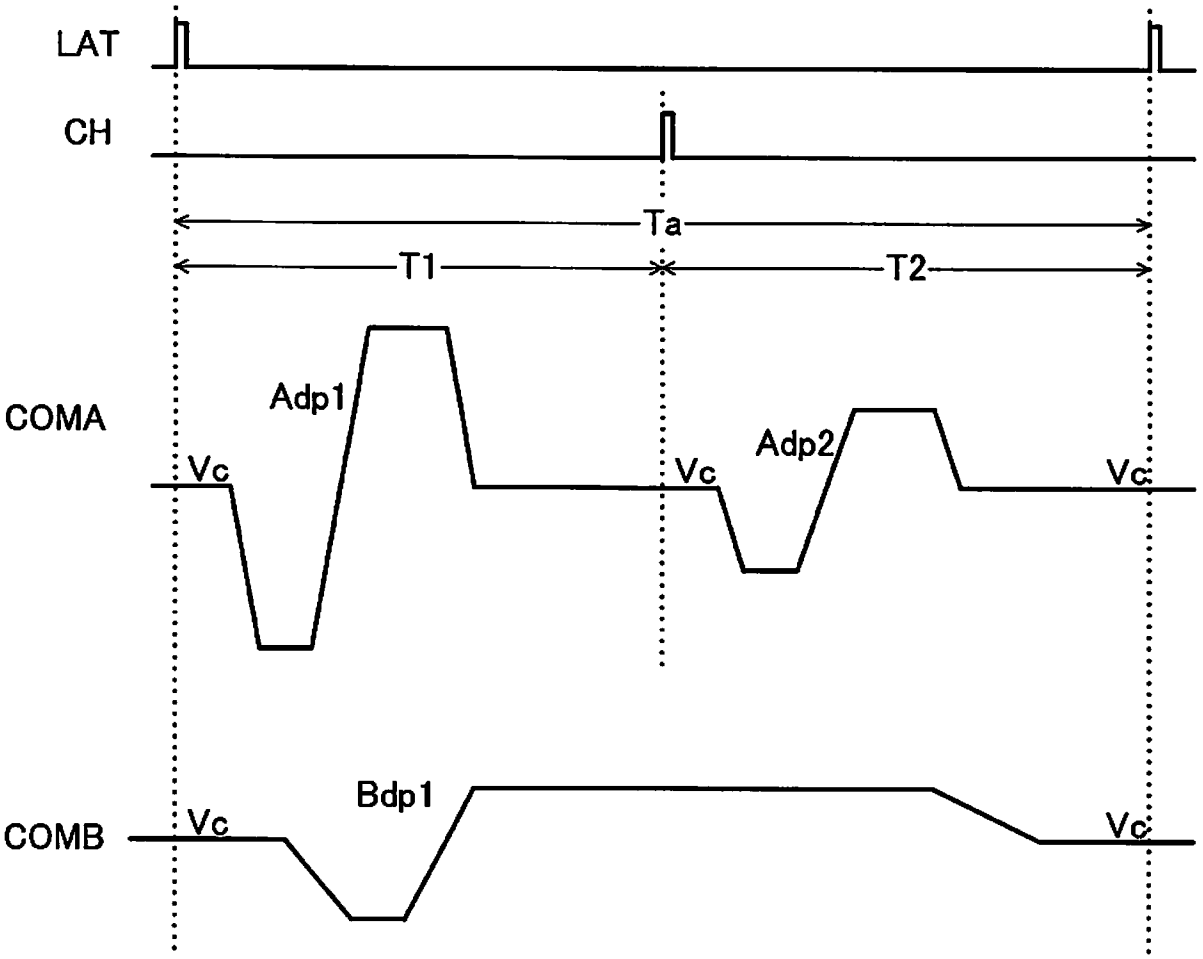
FIG. 5 is a diagram illustrating waveforms of drive signals.

FIG. 5 is a diagram illustrating waveforms of the drive signals COMA and COMB. As illustrated in FIG. 5, the drive signal COMA has a consecutive waveform of a trapezoidal waveform Adp1 disposed in a period T1 from a rising edge of a pulse of the latch signal LAT to a rising edge of a pulse of the change signal CH and a trapezoidal waveform Adp2 disposed in a period T2 from the rising edge of the pulse of the change signal CH to a rising edge of the next pulse of the latch signal LAT. A period configured by the period T1 and the period T2 is referred to as a cycle Ta, and a new dot is formed on the print medium P for each cycle Ta.

In the present embodiment, the trapezoidal waveforms Adp1 and Adp2 are different from each other. Among the trapezoidal waveforms, if the trapezoidal waveform Adp1 is supplied to one end of the piezoelectric element 60, the trapezoidal waveform Adp1 causes a predetermined amount, specifically, the intermediate amount of ink to be ejected from the nozzle 651 corresponding to the piezoelectric element 60. If the trapezoidal waveform Adp2 is supplied to one end of the piezoelectric element 60, the trapezoidal waveform Adp2 causes the amount less than the predetermined amount, specifically, the small amount of ink to be ejected from the nozzle 651 corresponding to the piezoelectric element 60.

The drive signal COMB has a trapezoidal waveform Bdp1 disposed in the entire cycle Ta. If the trapezoidal waveform Bdp1 is supplied to one end of the piezoelectric element 60, the trapezoidal waveform Bdp1 drives the piezoelectric element 60 such that ink droplets are not ejected from the nozzle 651.

Voltages at the start timing and voltages at the end timing of the trapezoidal waveforms Adp1, Adp2, and Bdp1 are common as a voltage Vc. That is, the trapezoidal waveforms Adp1, Adp2, and Bdp1 each have a waveform that starts at the voltage Vc and ends at the voltage Vc. The control unit 111 generates the drive data dA1 to dA4 and dB1 to dB4 such that the voltage Vc increases as a temperature of the ejection unit 600 (temperature of the head 21 indicated by the temperature signal VTEMP) decreases.

Figure 6:
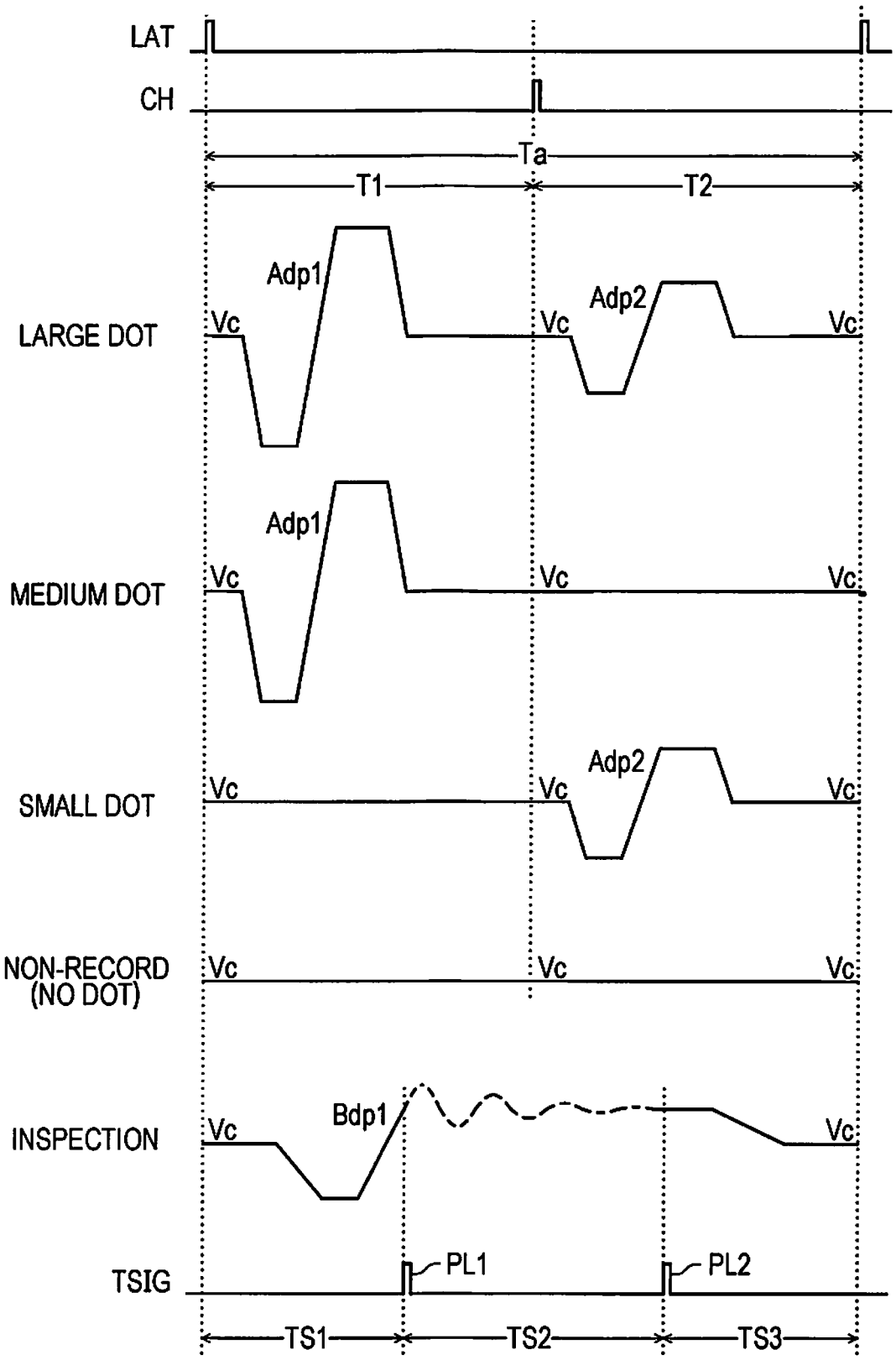
FIG. 6 is a diagram illustrating a waveform of a drive signal.

FIG. 6 is a diagram illustrating waveforms of the drive signals VOUT corresponding to a "large dot", a "medium dot", a "small dot", a "non-record", and an "inspection", respectively.

As illustrated in FIG. 6, the drive signal VOUT corresponding to the "large dot" has a consecutive waveform of the trapezoidal waveform Adp1 of the drive signal COMA in the period T1 and the trapezoidal waveform Adp2 of the drive signal COMA in the period T2. If the drive signal VOUT is supplied to one end of the piezoelectric element 60, medium and small amounts of ink are ejected twice from the nozzle 651 corresponding to the piezoelectric element 60 in the cycle Ta. Accordingly, the respective inks land on the print medium P and a large dot is formed as an integrated body.

The drive signal VOUT corresponding to the "medium dot" becomes the trapezoidal waveform Adp1 of the drive signal COMA in the period T1 and becomes a high impedance in the period T2, thereby, becoming the voltage Vc immediately before being held by a capacitive property of the piezoelectric element 60. If the drive signal VOUT is supplied to one end of the piezoelectric element 60, the intermediate amount of ink is ejected from the nozzle 651 corresponding to the piezoelectric element 60 only in the period T1 of the cycle Ta. Accordingly, the ink is landed on the print medium P and a medium dot is formed.

Since the drive signal VOUT corresponding to the "small dot" becomes a high impedance in the period T1, the drive signal becomes the voltage Vc immediately before being held by the capacitive property of the piezoelectric element 60, and becomes the trapezoidal waveform Adp2 of the drive signal COMA in the period T2. If the drive signal VOUT is supplied to one end of the piezoelectric element 60, the small amount of ink is ejected from the nozzle 651 corresponding to the piezoelectric element 60 only in the period T2 of the cycle Ta. Accordingly, the ink is landed on the print medium P and a small dot is formed.

Since the drive signal VOUT corresponding to the "non-record" becomes a high impedance in the periods T1 and T2, the drive signal becomes the voltage Vc immediately before being held by the capacitive property of the piezoelectric element 60. If the drive signal VOUT is supplied to one end of the piezoelectric element 60, ink is not ejected from the nozzle 651 corresponding to the piezoelectric element 60 in the cycle Ta. Accordingly, ink is not landed on the print medium P, and no dot is formed.

The drive signal VOUT corresponding to the "inspection" becomes a part of the trapezoidal waveform Bdp1 of the drive signal COMB in a period TS1 and a period TS3, and becomes a high impedance in a period TS2. Here, the periods TS1, TS2, and TS3 are defined by the inspection control signal TSIG. Specifically, the inspection control signal TSIG is a signal for instructing start of detection of the residual vibration made by each of the inspection circuits 80-1 to 80-4 to each ejection unit 600 and has a first pulse PL1 for defining detection start timing of the residual vibration in the cycle Ta. The inspection control signal TSIG is also a signal for instructing end of the detection of the residual vibration made by each of the inspection circuits 80-1 to 80-4 to each ejection unit 600 and has a second pulse PL2 for defining the detection end timing of the residual vibration in the cycle Ta. The cycle Ta is divided into the period TS1 from a rising edge of a pulse of the latch signal LAT to a rising edge of a first pulse PL1, a period TS2 from the rising edge of the first pulse PL1 to a rising edge of a second pulse PL2, and the period TS3 from the rising edge of the second pulse PL2 of the inspection control signal TSIG to a rising edge of the next pulse of the latch signal LAT.

If the drive signal VOUT for inspection is supplied to one end of the piezoelectric element 60, the cavity 631 is rapidly expanded according to a rise of a potential of the drive signal VOUT and thereafter, the cavity 631 is rapidly contracted according to a rise of the potential of the drive signal VOUT in the period TS1 in the ejection unit 600 including the piezoelectric element 60. Thereafter, if the potential of the drive signal VOUT completes the rise and reaches a constant potential, the cavity 631 returns to an original volume while repeating expansion and contraction, but at this time, vibration (residual vibration) that attenuates with the lapse of time occurs in the cavity 631 and is applied to the piezoelectric element 60. An electromotive force of the piezoelectric element 60 changes according to the residual vibration, and a residual vibration waveform appears in the drive signal VOUT in the period TS2. Although details will be described below, in the present embodiment, an ejection state of the ejection unit 600 which is an inspection target is determined based on the residual vibration waveform appearing in the drive signal VOUT in the inspection circuits 80-1 to 80-4.

In the present embodiment, it is possible to perform any one or both of printing processing of supplying a drive signal VOUT for a "large dot", a "medium dot", a "small dot" or a "non-record" for each ejection unit 600 and inspection processing of supplying the drive signal VOUT for "inspection and determining an ejection state, in each cycle Ta. The liquid ejecting apparatus 1 repeatedly perform the print processing over a plurality of continuous or intermittent periods Ta to form an image corresponding to image data on the print medium P.

For example, the drive signal VOUT for the "inspection" may be supplied instead of this in each of the plurality of cycles Ta, for any one of the ejection units 600 to which the drive signal VOUT for the "non-record" is supplied in the print processing. In the present embodiment, the liquid ejecting apparatus 1 include four inspection circuits 80-1 to 80-4, and thus, in a case where an image corresponding to image data is formed on the print medium P over M cycles Ta, it is possible to perform inspection processing for maximum M×4 ejection units 600 in parallel with the print processing.

In addition, for example, the inspection processing may be performed in a period in which the print processing is not necessary (a period or the like from an end of printing of one page to a start of printing of the next page, in a case where a plurality of pages is printed) or may be performed separately from the print processing in a case of being set to an inspection mode.

1-5. Configuration of Switching Circuit

Figure 7:
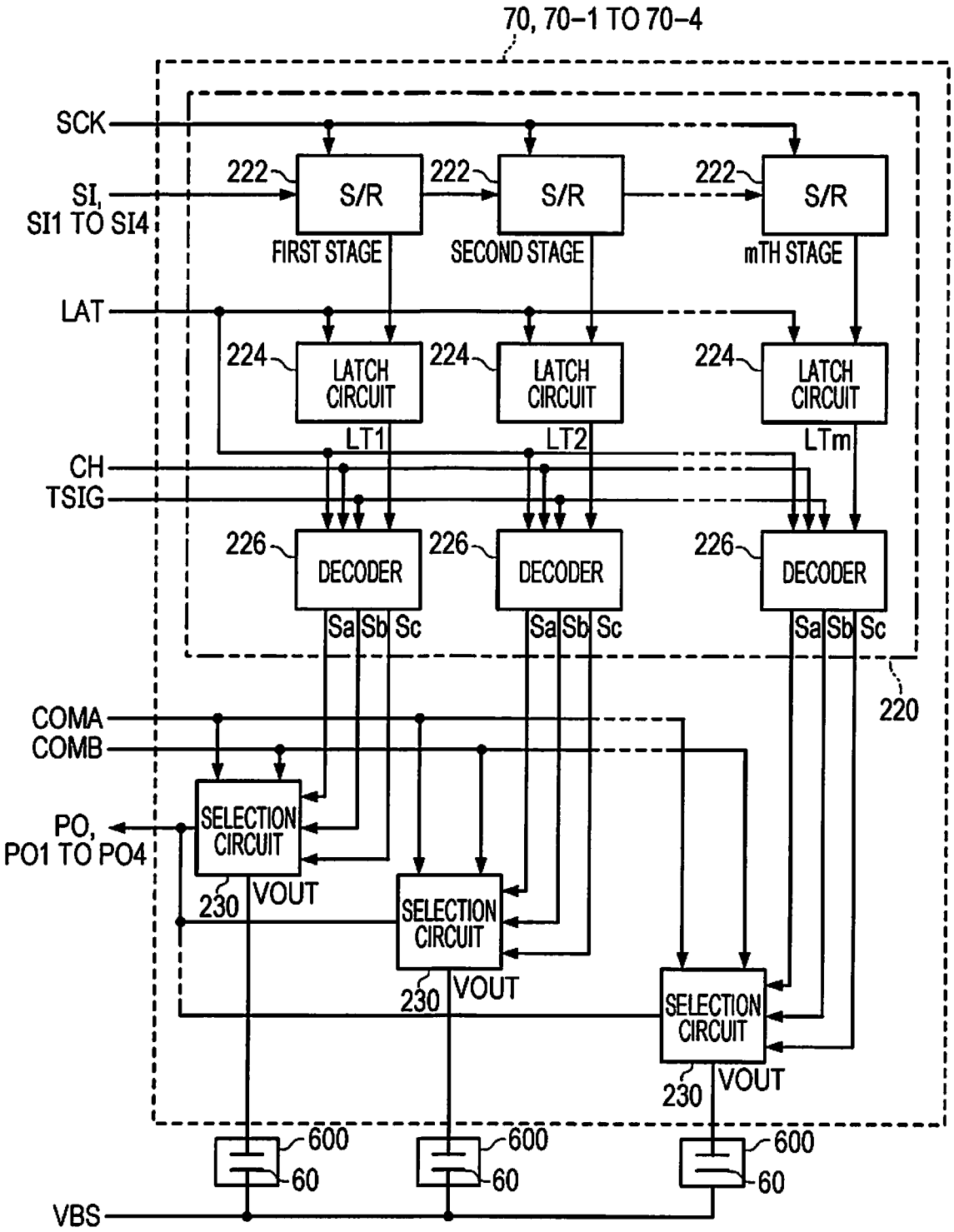
FIG. 7 is a diagram illustrating a configuration of a switching circuit.

Next, a configuration of the switching circuit 70 (70-1 to 70-4) will be described. FIG. 7 is a diagram illustrating the configuration of the switching circuit 70 (70-1 to 70-4). As illustrated in FIG. 7, the switching circuit 70 includes a selection control unit 220 and a plurality of selection circuits 230.

The clock signal SCK, the print data signal SI (any one of SI1 to SI4), the latch signal LAT, the change signal CH, and the inspection control signal TSIG are supplied to the selection control unit 220. The selection control unit 220 includes a set of a shift register (S/R) 222, a latch circuit 224, and a decoder 226 corresponding to each of the piezoelectric elements 60 (nozzles 651). That is, the number of sets of the shift register (S/R) 222, the latch circuit 224, and the decoder 226 included in one switching circuit 70 is the same as a total number m of the nozzles 651 included in the two nozzle arrays 650.

The print data signal SI includes three bits of print data (SIH, SIM, and SIL) for selecting one of the "large dot", the "medium dot", the "small dot", the "non-record", and the "inspection" for each of the m ejection units 600 (piezoelectric elements 60), and is in total of three m bits.

The print data signal SI is synchronized with the clock signal SCK and the shift register 222 is configured to temporarily hold the print data (SIH, SIM, and SIL) corresponding to three bits included in the print data signal SI, corresponding to the nozzle 651.

In detail, the shift registers 222 of the number of stages corresponding to the piezoelectric elements 60 (nozzles 651) are connected in cascade to each other, and the print data signals SI supplied serially are sequentially transmitted to a subsequent stage in response to the clock signal SCK.

In order to distinguish the shift registers 222, the shift registers are sequentially denoted as a first stage, a second stage, mth stage from an upstream side to which the print data signal SI is supplied.

Each of the m latch circuits 224 latches the print data (SIH, SIM, and SIL) of three bits held by each of the m shift registers 222 at a rising edge of the latch signal LAT.

Each of the m number of decoders 226 decodes the print data (SIH, SIM, and SIL) of three bits latched by each of the m latch circuits 224, outputs a selection signal Sa in each of the periods T1 and T2 defined by the latch signal LAT and the change signal CH, outputs selection signals Sb and Sc in each of the periods TS1, TS2, and TS3 defined by the latch signal LAT and the inspection control signal TSIG, and defines selection made by the selection circuit 230.

Figures 8, 9:
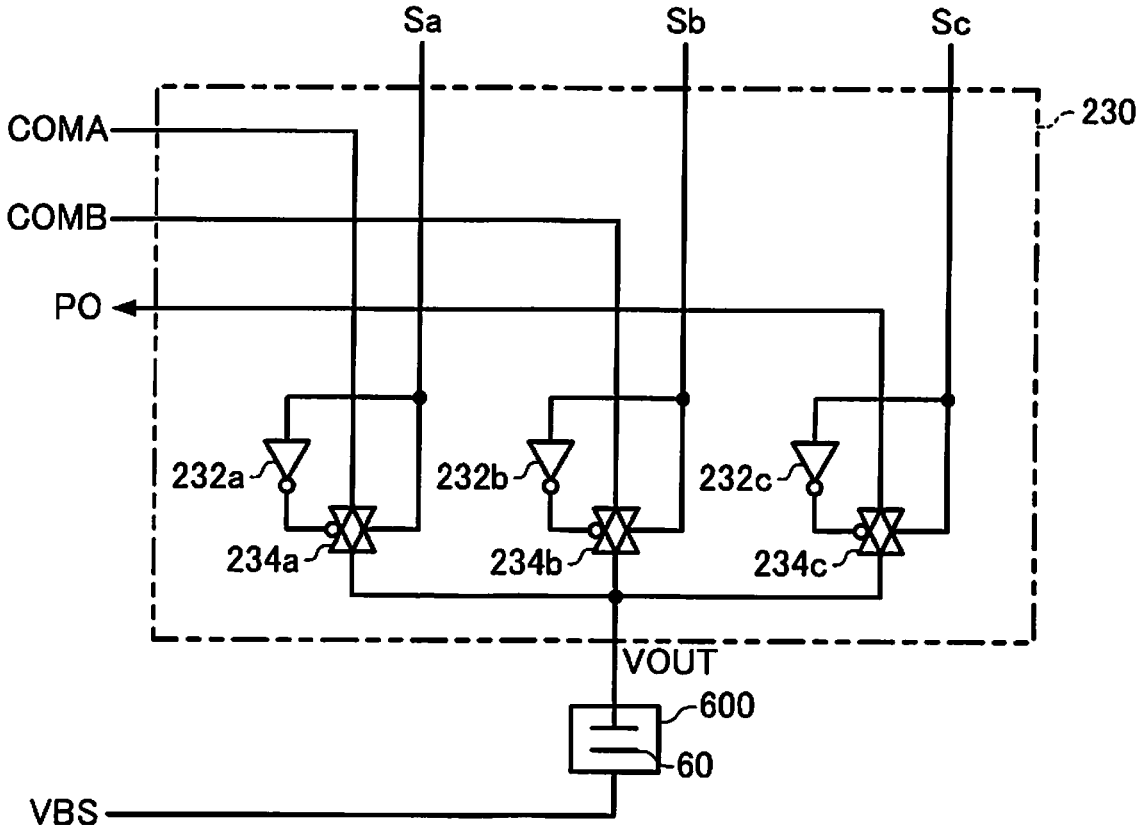
FIG. 8 is a diagram illustrating decoding contents in a decoder.
FIG. 9 is a diagram illustrating a configuration of a selection circuit.

FIG. 8 is a diagram illustrating decoding content of the decoder 226. As illustrated in FIG. 8, if the latched print data (SIH, SIM, and SIL) of three bits is (1, 1, and 0) indicating the "large dot", the decoder 226 outputs a logic level of the selection signal Sa Level as a H level in any of the periods T1 and T2 and outputs logic levels of the selection signals Sb and Sc as a L level in any of the periods TS1, TS2, and TS3.

If the print data (SIH, SIM, and SIL) of three bits is (1, 0, and 0) indicating the "medium dot", the decoder 226 sets the logic level of the selection signal Sa to a H level in the period T1, outputs the logic level as an L level in the period T2, and outputs the logic levels of the selection signals Sb and Sc as an L level in any of the periods TS1, TS2, and TS3.

If the print data (SIH, SIM, and SIL) of three bits is (0, 1, and 0) indicating the "small dot", the decoder 226 sets the logic level of the selection signal Sa to an L level in the period T1, outputs the logic level as an H level in the period T2, and outputs the logic levels of the selection signals Sb and Sc as an L level in any of the periods TS1, TS2, and TS3.

If the print data (SIH, SIM, and SIL) of three bits is (0, 0, and 0) indicating the "no record", the decoder 226 outputs the logic level of the selection signal Sa as an L level in either of the periods T1 and T2 and outputs the logic levels of the selection signals Sb and Sc as an L level in any of the periods TS1, TS2, and TS3.

If the print data (SIH, SIM, and SIL) of three bits is (1, 1, and 1) indicating the "inspection", the decoder 226 outputs the logic level of the selection signal Sa as an L Level in any of the periods T1 and T2, outputs the logic level of the selection signal Sb as an H level in the periods TS1 and TS3, outputs the logic level of the selection signal Sb as an L level in the period TS2, outputs the logical level of the selection signal Sc as an L level in the periods TS1 and TS3, and outputs the logical level of the selection signal Sc as an H level in the period TS2.

The logic levels of the selection signals Sa, Sb, and Sc are level-shifted to a high amplitude logic higher than the logic levels of the clock signal SCK, the print data signal SI, the latch signal LAT, the change signal CH, and the inspection control signal TSIG by level shifters (not illustrated).

The selection circuit 230 is provided corresponding to each of the piezoelectric elements 60 (nozzles 651). That is, the number of the selection circuits 230 included in one switching circuit 70 is the same as the total number m of the nozzles 651 included in the two nozzle arrays 650.

FIG. 9 is a diagram illustrating a configuration of the selection circuit 230 corresponding to one piezoelectric element 60 (nozzle 651).

As illustrated in FIG. 9, the selection circuit 230 includes inverters (NOT circuits) 232*a*, 232*b*, 232*c* and transfer gates 234*a*, 234*b*, and 234*c*.

The selection signal Sa from the decoder 226 is supplied to a positive control end of the transfer gate 234*a*, is logically inverted by the inverter 232*a* and is supplied to a negative control end of the transfer gate 234*a*. Likewise, the selection signal Sb is supplied to a positive control end of the transfer gate 234*b*, is logically inverted by the inverter 232*b*, and is supplied to a negative control end of the transfer gate 234*b*. Likewise, the selection signal Sc is supplied to a positive control end of the transfer gate 234*c*, is logically inverted by the inverter 232*c*, and is supplied to a negative control end of the transfer gate 234*c*.

The drive signal COMA is supplied to an input terminal of the transfer gate 234*a*, and the drive signal COMB is supplied to an input terminal of the transfer gate 234*b*. Output ends of the transfer gates 234*a* and 234*b* are commonly connected and are connected to one end of the piezoelectric element 60 included in the ejection unit 600.

An input end of the transfer gate 234*c* is connected to commonly connected to output ends of the transfer gates 234*a* and 234*b* and one end of the piezoelectric element 60 included in the ejection unit 600. An output terminal of the transfer gate 234*c* is commonly connected to output terminals of the transfer gates 234*c* of all the other selection circuits 230 of the switching circuit 70 (see FIG. 7).

If the selection signal Sa is at the H level, the transfer gate 234*a* is conducted (ON) between the input terminal and the output terminal. If the selection signal Sa is at the L level, the transfer gate 234*a* is not conducted (OFF) between the input terminal and the output terminal. Likewise, the transfer gates 234*b* and 234*c* are conducted or not conducted between the input terminals and the output terminals in response to the selection signals Sb and Sc.

As the transfer gate 234*a* is turned on, the drive signal COMA is supplied to one end of the piezoelectric element 60 as the drive signal VOUT, and as the transfer gate 234*b* is turned on, the drive signal COMB is supplied to one end of the piezoelectric element 60 as the drive signal VOUT. As the transfer gate 234*c* is turned on, the inspection target signal PO having a waveform based on the residual vibration generated in the ejection unit 600 is output to the inspection circuit 80.

Next, an operation of the switching circuit 70 (70-1 to 70-4) will be described with reference to FIG. 10.

The print data signals SI (all of SI1 to SI4) are serially supplied in synchronization with the clock signal SCK and are sequentially transmitted to the shift registers 222 corresponding to the nozzle. If supplying the clock signal SCK is stopped, the print data (SIH, SIM, SIL) of three bits corresponding to the nozzle 651 is held in each of the shift registers 222. The print data signals SI are supplied in the order corresponding to the nozzles of the last m stage, . . . , the second stage, and the first stage in the shift registers 222.

Here, if the latch signal LAT rises, each of the latch circuits 224 latches the print data (SIH, SIM, and SIL) of three bits held in the shift register 222 all at once. In FIG. 10, LT1, LT2, . . . , LTm denote the print data (SIH, SIM, and SIL) of three bits latched by the latch circuits 224 corresponding to the first, second, mth shift registers 222, Respectively.

The decoder 226 outputs the logic level of the selection signal Sa as contents illustrated in FIG. 8 in each of the periods T1 and T2, according to the latched print data (SIH, SIM, and SIL) of three bits, and outputs the logic levels of the selection signals Sb and Sc as contents illustrated in FIG. 8 in each of the periods TS1, TS2, and TS3.

That is, in a case where the print data (SIH, SIM, and SIL) is (1, 1, and 0), the decoder 226 sets the selection signal Sa to H and H levels in the periods T1 and T2 and sets the selection signals Sb and Sc to L, L, and L levels in the periods TS1, TS2, and TS3. In a case where the print data (SIH, SIM, and SIL) is (1, 0, and 0), the decoder 226 sets the selection signal Sa to H and L levels in the periods T1 and T2 and sets the selection signals Sb and Sc to L, L, and L levels in the periods TS1, TS2, and TS3. In a case where the print data (SIH, SIM, and SIL) is (0, 1, and 0), the decoder 226 sets the selection signal Sa to L and H levels in the periods T1 and T2 and sets the selection signals Sb and Sc to L, L, and L levels in the periods TS1, TS2, and TS3. In a case where the print data (SIH, SIM, and SIL) is (0, 0, and 0), the decoder 226 sets the selection signal Sa to L and L levels in the periods T1 and T2 and sets the selection signals Sb and Sc to L, L, and L levels in the periods TS1, TS2, and TS3. In a case where the print data (SIH, SIM, and SIL) is (1, 1, and 1), the decoder 226 sets the selection signal Sa to L and L levels in the periods T1 and T2, sets the selection signal Sb to H, L, and H levels in the period TS1, TS2, and TS3, and sets the selection signal Sc to L, H, and L levels in the periods TS1, TS2, and TS3.

When the print data (SIH, SIM, and SIL) is (1, 1, and 0), the selection circuit 230 selects the drive signal COMA (trapezoidal waveform Adp1) since the selection signal Sa is at an H level in the period T1, and selects the drive signal COMA (trapezoidal waveform Adp2) since the selection signal Sa is also at an H level also in the period T2. In addition, the selection circuit 230 does not select the drive signal COMB since the selection signal Sb is at an L level in the periods TS1, TS2, and TS3. As a result, the drive signal VOUT corresponding to the "large dot" illustrated in FIG. 6 is generated.

When the print data (SIH, SIM, and SIL) is (1, 0, and 0), the selection circuit 230 selects the drive signal COMA (trapezoidal waveform Adp1) since the selection signal Sa is at the H level in the period T1, and does not select the drive signal COMA since the selection signal Sa is at the L level in the period T2. In addition, the selection circuit 230 does not select the drive signal COMB since the selection signal Sb is at the L level in the periods TS1, TS2, and TS3. As a result, the drive signal VOUT corresponding to the "medium dot" illustrated in FIG. 6 is generated.

When the print data (SIH, SIM, and SIL) is (0, 1, and 0), the selection circuit 230 does not select the drive signal COMA since the selection signal Sa is at the L level in the period T1, and selects the drive signal COMA (trapezoidal waveform Adp2) since the selection signal Sa is at the H level in the period T2. In addition, the selection circuit 230 does not select the drive signal COMB since the selection signal Sb is at the L level in the periods TS1, TS2, and TS3. As a result, the drive signal VOUT corresponding to the "small dot" illustrated in FIG. 6 is generated.

When the print data (SIH, SIM, and SIL) is (0, 0, and 0), the selection circuit 230 does not select the drive signal COMA since the selection signal Sa is at the L level in the periods T1 and T2. In addition, the selection circuit 230 does not select the drive signal COMB since the selection signal Sb is at the L level in the periods TS1, TS2, and TS3. As a result, the drive signal VOUT corresponding to the "non-record" illustrated in FIG. 6 is generated.

When the print data (SIH, SIM, and SIL) is (1, 1, and 1), the selection circuit 230 does not select the drive signal COMA since the selection signal Sa is at the L level in the periods T1 and T2. In addition, the selection circuit 230 selects the drive signal COMB (a part of the trapezoidal waveform Bdp1) since the selection signal Sb is at the H level in the periods TS1 and TS3, and does not select the drive signal COMB the selection signal Sb is at the L level in the period TS2. As a result, the drive signal VOUT corresponding to the "inspection" illustrated in FIG. 6 is generated in the periods TS1 and TS3. The selection circuit 230 turns off the transfer gate 234*c* since the selection signal Sc is at the L level in the periods TS1 and TS3, and turns on the transfer gate 234*c* since the selection signal Sc is at the H level in the period TS2. As a result, the inspection target signal PO is generated in the period TS2.

Figure 10:
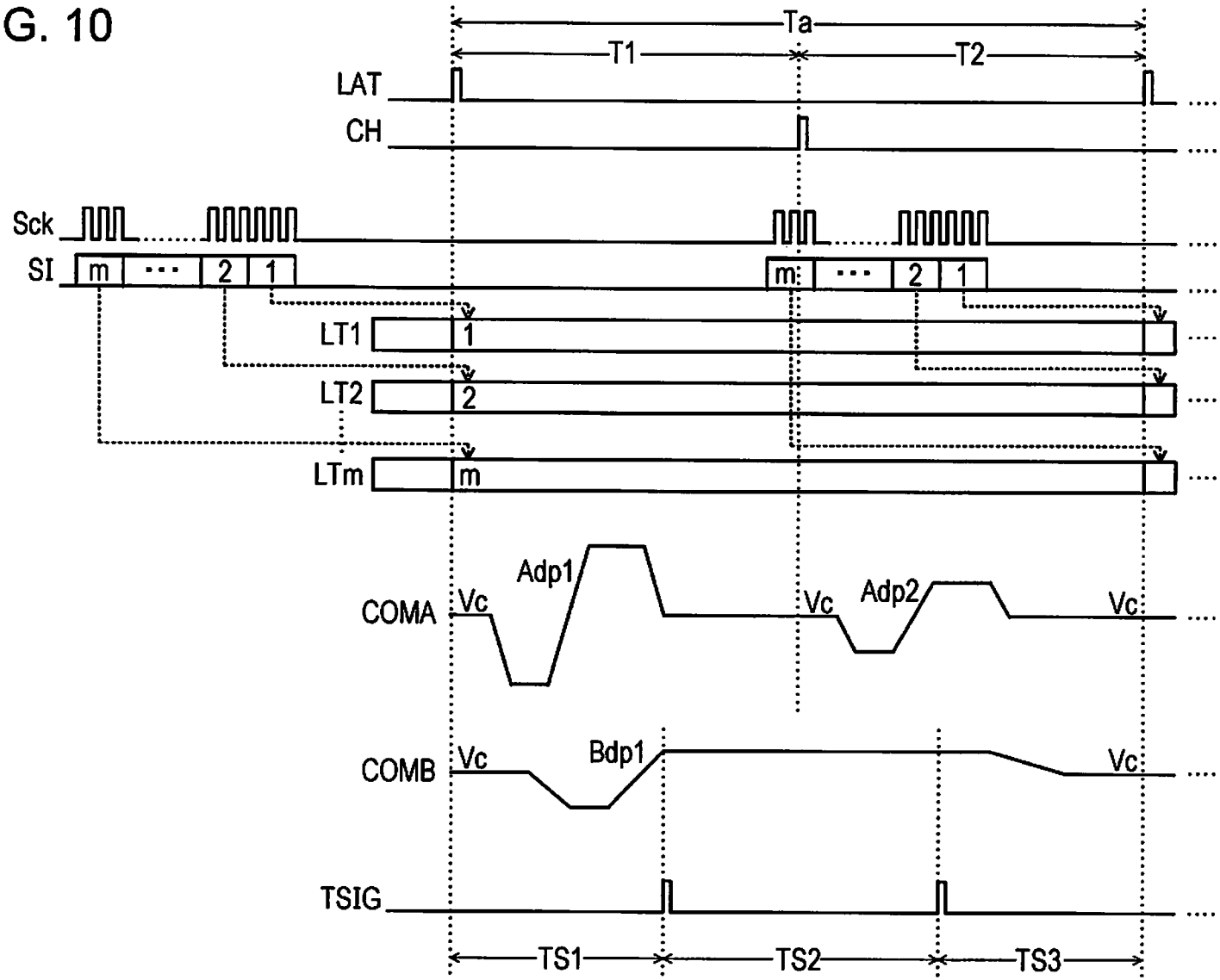
FIG. 10 is a diagram illustrating an operation of the switching circuit.

The drive signals COMA and COMB illustrated in FIGS. 5 and 10 are merely examples. Actually, combinations of various waveforms previously prepared are used depending on a moving speed of the head unit 20, structures of the print medium P and the ejection unit 600, a viscosity of the ink, and the like.

Here, an example in which the piezoelectric element 60 is bent upward as a voltage decreases is described, and if voltages supplied to the electrodes 611 and 612 are reversed, the piezoelectric element 60 is bent downward as the voltage decreases. Accordingly, in a configuration in which the piezoelectric element 60 is bent downward as the voltage decreases, the drive signals COMA and COMB illustrated in FIGS. 5 and 10 have inverted waveforms with respect to the voltage Vc.

1-6. Configuration of Inspection Circuit

Figure 11:
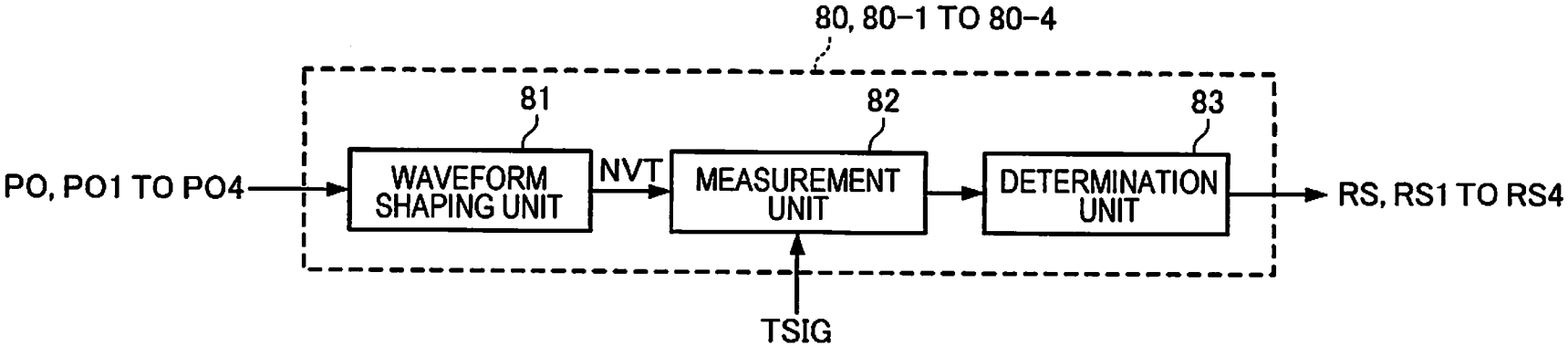
FIG. 11 is a diagram illustrating a configuration of an inspection circuit.

Next, a configuration of the inspection circuit 80 (80-1 to 80-4) will be described. FIG. 11 is a diagram illustrating the configuration of the inspection circuit 80 (80-1 to 80-4). As illustrated in FIG. 11, the inspection circuit 80 includes a waveform shaping unit 81, a measurement unit 82, and a determination unit 83.

The waveform shaping unit 81 removes noise components from the inspection target signal PO (any one of PO1 to PO4) by using a low pass filter or a band pass filter, and outputs a residual vibration signal NVT obtained by amplifying an amplitude of the inspection target signal PO using an operational amplifier, a resistor, and the like.

The measurement unit 82 receives the residual vibration signal NVT output from the waveform shaping unit 81 and measures a phase, a cycle, an amplitude, and the like of the residual vibration signal NVT in the period TS2 designated by the inspection control signal TSIG.

The determination unit 83 determines an ejection state of the inspection target ejection unit 600, based on the phase, the cycle, the amplitude, and the like of the residual vibration signal NVT measured by the measurement unit 82, and outputs the determination result signal RS (any one of RS1 to RS4) representing a determination result. The determination result signal RS may be a signal indicating presence or absence of ejection abnormality, or may be a signal including information obtained by determining a cause of the ejection abnormality.

Figure 12:
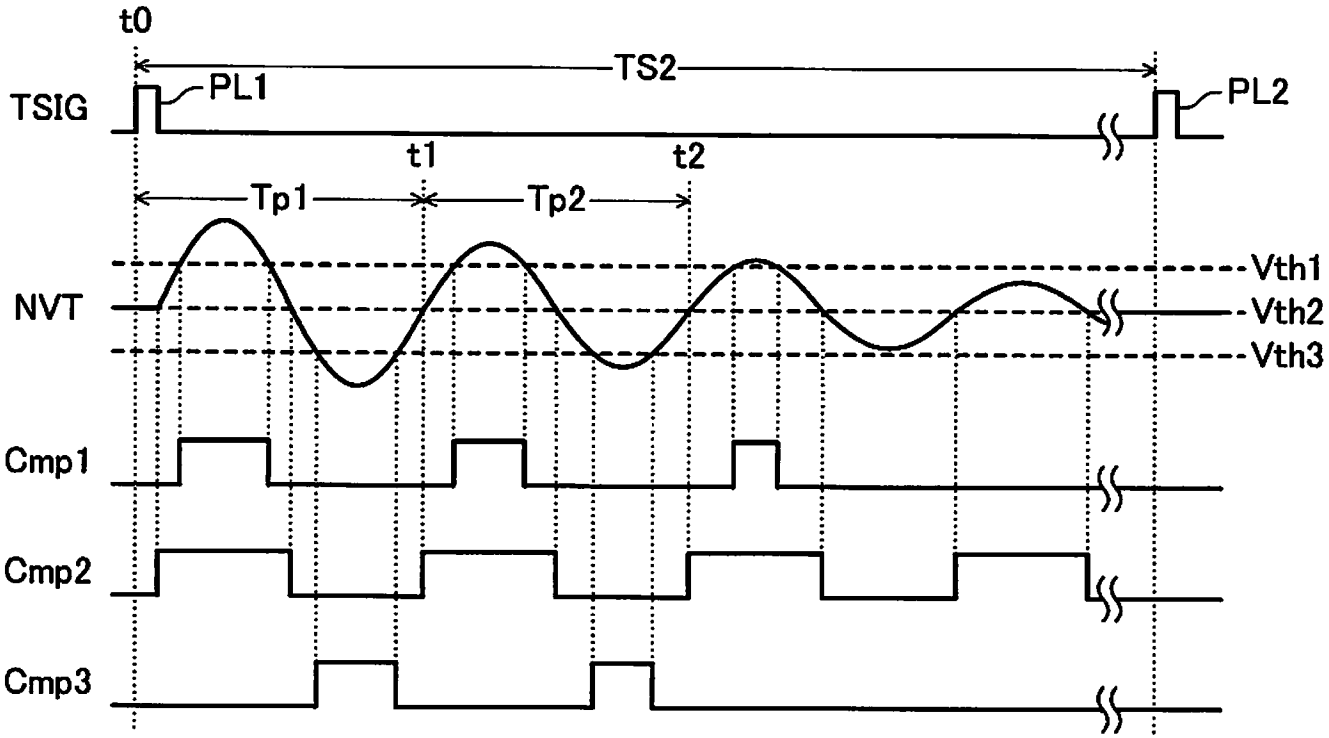
FIG. 12 is a diagram illustrating an operation of a measurement unit.

FIG. 12 is a timing chart illustrating an operation of the measurement unit 82. As illustrated in FIG. 12, if the period TS2 starts and supplying the residual vibration signal NVT is started, the measurement unit 82 compares the residual vibration signal NVT, a threshold potential Vth2 which is a potential of a central amplitude level of the residual vibration signal NVT, a threshold potential Vth1 higher than the threshold potential Vth2, and a threshold potential Vth3 lower than the threshold potential Vth2 with each other. Then the measurement unit 82 generates a comparison signal Cmp1 going to a high level in a case where the potential of the residual vibration signal NVT is higher than or equal to the threshold potential Vth1, a comparison signal Cmp2 going to a high level in a case where the potential of the residual vibration signal NVT becomes the threshold potential Vth2, and a comparison signal Cmp3 going to a high level in a case where the potential of the residual vibration signal NVT is lower than the threshold potential Vth3.

Then, the measurement unit 82 measures time Tp1 from a start time t0 of the period TS2 to time t1 when the comparison signal Cmp2 first falls to a low level and then rises to a high level. In addition, the measurement unit 82 measures the time Tp2 from the time t1 to time t2 when the comparison signal Cmp2' falls to a next low level and then rises to the high level.

For example, the measurement unit 82 can count the number of pulses of the clock signal SCK from the time t0 to the time t1, set the counted value to the time Tp1, count the number of pulses of the clock signal SCK from the time t1 to the time t2, and set the counted value to the time Tp2.

In addition, it is assumed that, in a case where an amplitude of the residual vibration signal NVT is small, ejection abnormality occurs in the inspection target ejection unit 600, such as no ink filled in the cavity 631. Therefore, in a case where the potential of the residual vibration signal NVT is higher than or equal to the threshold potential Vth1 (that is, the comparison signal Cmp1 goes to a high level) in a period from the time t1 to the time t2 and the potential of the residual vibration signal NVT is lower than the threshold potential Vth3 (that is, the comparison signal Cmp3 goes to a high level) in the period from the time t1 to the time t2, the measurement unit 82 sets the amplitude determination value Ap to "1" and sets the amplitude determination value Ap to "0" in other cases.

Causes of ink droplets not being ejected normally from the nozzle 651, that is, a cause of the ejection abnormality occurring regardless that the ejection unit 600 performs an operation to eject ink droplets are (1) mixing of air bubbles into the cavity 631, (2) thickening of the ink in the cavity 631 due to drying of the ink in the cavity 631, (3) adhesion of foreign matter such as paper dust to the vicinity of an exit of the nozzle 651, and the like.

First, in a case where the air bubbles are mixed into the cavity 631, it is considered that a total weight of the ink filling the cavity 631 decreases and the inertance decreases. In addition, in a case where the air bubbles adhere to the vicinity of the nozzle 651, it is considered that the nozzle 651 increases in diameter by a size of the diameter and an acoustic resistance is reduced. Accordingly, in a case where the air bubbles are mixed in the cavity 631 and the ejection abnormality occurs, a frequency of the residual vibration becomes higher than in a case where the ejection state is normal. Accordingly, the time Tp2 becomes smaller than the predetermined threshold time Tth2. In addition, if mixing of the air bubbles increase, the time Tp1 becomes smaller than the predetermined threshold time Tth1.

Next, in a case where the ink near the nozzle 651 is dried and thickened, the ink in the cavity 631 is confined within the cavity 631. In this case, it is considered that the acoustic resistance increases. Accordingly, in a case where the ink near the nozzle 651 in the cavity 631 is thickened, a frequency of the residual vibration becomes lower than in a case where the ejection state is normal. Accordingly, the time Tp2 becomes larger than the predetermined threshold time Tth4.

Next, in a case where a foreign matter such as paper dust adheres to the vicinity of the exit of the nozzle 651, the ink seeps out from the inside of the cavity 631 via s foreign matter such as paper dust, and thus, the inertance is considered to increase. In addition, it is also considered that the acoustic resistance increases due to fibers of the paper dust adhering to the vicinity of the exit of the nozzle 651. Accordingly, in a case where the foreign matter such as paper dust adheres to the vicinity of the exit of the nozzle 651, the frequency of the residual vibration becomes lower than in a case where the ejection state is normal. Accordingly, the time Tp2 becomes is greater than the predetermined threshold time Tth3 and becomes less than or equal to the threshold time Tth4.

In a case where there is no ejection abnormality due to the causes of (1) to (3), that is, in a case where the time Tp2 is longer than or equal to the threshold time Tth2 and shorter than or equal to the threshold time Tth3, it is determined that the ejection state of the ejection unit 600 is normal.

Thereby, the determination unit 83 can determine the ejection state (presence or absence of the ejection abnormality, a cause of the ejection abnormality, or the like) of the ejection unit 600 of an inspection target, based on the time Tp1 corresponding to the phase of the residual vibration, the time Tp2 corresponding to the cycle of the residual vibration, and the amplitude determination value Ap of the residual vibration.

FIG. 13 is a diagram illustrating an example of a determination logic of the ejection state of the ejection unit 600 determined by the determination unit 83. In the example of FIG. 13, in a case where the time Tp1 is smaller than the threshold time Tth1, the determination unit 83 determines that an ejection abnormality due to air bubbles occurs in the ejection unit 600 regardless of the time Tp2 and the amplitude determination value Ap, and sets the determination result signal RS to "2".

In addition, in a case where the time Tp1 is shorter than or equal to the threshold time Tth1, the determination unit 83 determines the ejection state of the ejection unit 600, based on the time Tp2 and the amplitude determination value Ap. Specifically, if the amplitude determination value Ap is "0", the determination unit 83 determines that a certain ejection abnormality such as no ink filled in the cavity 631 occurs even though the cause cannot be defined, and sets the determination result signal RS to "5". In addition, if the amplitude determination value Ap is "1", the determination unit 83 determines the ejection state of the ejection unit 600, based on the time Tp2. That is, in a case where the time Tp2 is shorter than the threshold time Tth2, the determination unit 83 determines that the ejection abnormality due to air bubbles occurs in the ejection unit 600, and sets the determination result signal RS to "2". In a case where the time Tp2 is longer than or equal to the threshold time Tth2 and shorter than or equal to the threshold time Tth3, the determination unit 83 determines that the ejection state of the ejection unit 600 is normal (ejection abnormality does not occur), and sets the determination result signal RS to "1". In a case where the time Tp2 is longer than the threshold time Tth3 and is shorter than or equal to the threshold time Tth4, the determination unit 83 determines that the ejection abnormality due to adhesion of a foreign matter to the ejection unit 600 occurs, and sets the determination result signal RS to "3". In a case where the time Tp2 is longer than the threshold time Tth4, the determination unit 83 determines that the ejection abnormality due to thickening occurs in the ejection unit 600, and sets the determination result signal RS to "4".

The determination result signal RS generated by the determination unit 83 is five-valued information from "1" to "5" in the example of FIG. 13, but may be binary information indicating whether or not presence or absence of the ejection abnormality is represented. In addition, the determination unit 83 may use only a part of the time Tp1, the time Tp2, and the amplitude determination value Ap to generate the determination result signal RS.

1-7. Temperature Correction of Inspection Control Signal TSIG and Drive Signal COMB A viscosity of the ink filled in the cavity 631 of the temperature correction ejection unit 600 changes depending on a temperature. That is, the higher the temperature, the lower the viscosity of the ink, and the lower the temperature, the higher the viscosity of the ink. Thus, in a case where a constant drive signal is supplied to the ejection unit 600, the higher the viscosity of the ink, the smaller the residual vibration generated after the ejection unit 600 is driven, and the lower the ink viscosity, the larger the residual vibration. From the above, it can be said that the residual vibration becomes larger as the temperature (ink temperature) of the ejection unit 600 is higher and the residual vibration becomes smaller as the temperature of the ejection unit 600 is lower. Accordingly, since the amplitude of the residual vibration signal NVT changes depending on the temperature, if the threshold potentials Vth1 to Vth3 (see FIG. 12) do not change depending on the temperature, the determination made by the determination unit 83 will be erroneous. However, if the threshold potentials Vth1 to Vth3 change depending on the temperature, an inspection sequence from the detection of the residual vibration to the determination of the ejection state is easily complicated.

Therefore, in the present embodiment, in order to further simplify the inspection sequence, the amplitude of the drive signal COMB is corrected depending on the temperature, and thereby, the residual vibration in a case where the ejection unit 600 is normal has a constant magnitude regardless of the temperature. That is, the control unit 111 changes the drive data dB1 to dB4 depending on the temperature (temperature of the head 21 indicated by the temperature signal VTEMP) of the ejection unit 600 such that the respective amplitudes of the inspection target signals PO1 to PO4 or the residual vibration signals NVT (NVT1 to NVT4) are constant regardless of the temperature of the ejection unit 600. Specifically, the control unit 111 changes the drive data dB1 to dB4 depending on the temperature such that the amplitude of the drive signal COMB decreases as the temperature increases and the amplitude of the drive signal COMB increases as the temperature decreases.

As such, by changing the amplitude of the drive signal COMB depending on the temperature, the amplitude of the residual vibration signal NVT with respect to the ejection unit 600 becomes constant regardless of the temperature, and thus, there is no need to change the threshold potentials Vth1 to Vth3 depending on the temperature. However, if the amplitude of the drive signal COMB changes depending on the temperature, the timing at which falling or rising of a potential ends also changes, and thus, the timing at which the residual vibration starts in the ejection unit 600 changes depending on the temperature. Specifically, since the amplitude of the drive signal COMB decreases as the temperature increases, the timing at which falling or rising of the potential ends becomes earlier, and since the amplitude of the drive signal COMB increases as the temperature decreases, the timing at which falling or rising of the potential is delayed. As a result, the timing at which the residual vibration starts changes depending on the temperature, and a phase of the residual vibration signal NVT at the time of detection start of the residual vibration also changes, and thus, the if the threshold time Tth1 of the above-described time Tp1 does not change depending on the temperature, the determination made by the determination unit 83 will be erroneous. However, it is not preferable to change the threshold time Tth1 depending on the temperature for simplifying an inspection sequence.

Therefore, in the present embodiment, in order to further simplify the inspection sequence, the inspection control signal TSIG changes depending on the temperature such that the phase of the residual vibration signal NVT at the time of detection start of the residual vibration is constant regardless of the temperature change. Thereby, in a case where the ejection unit 600 is normal, the time Tp1 is constant regardless of the temperature. Specifically, the control unit 111 corrects the inspection control signal TSIG according to the temperature such that the timings of the first pulse PL1 and the second pulse PL2 are earlier as the temperature is higher and the timings of the first pulse PL1 and the second pulse PL2 are delayed as the temperature is lower.

Figure 14:
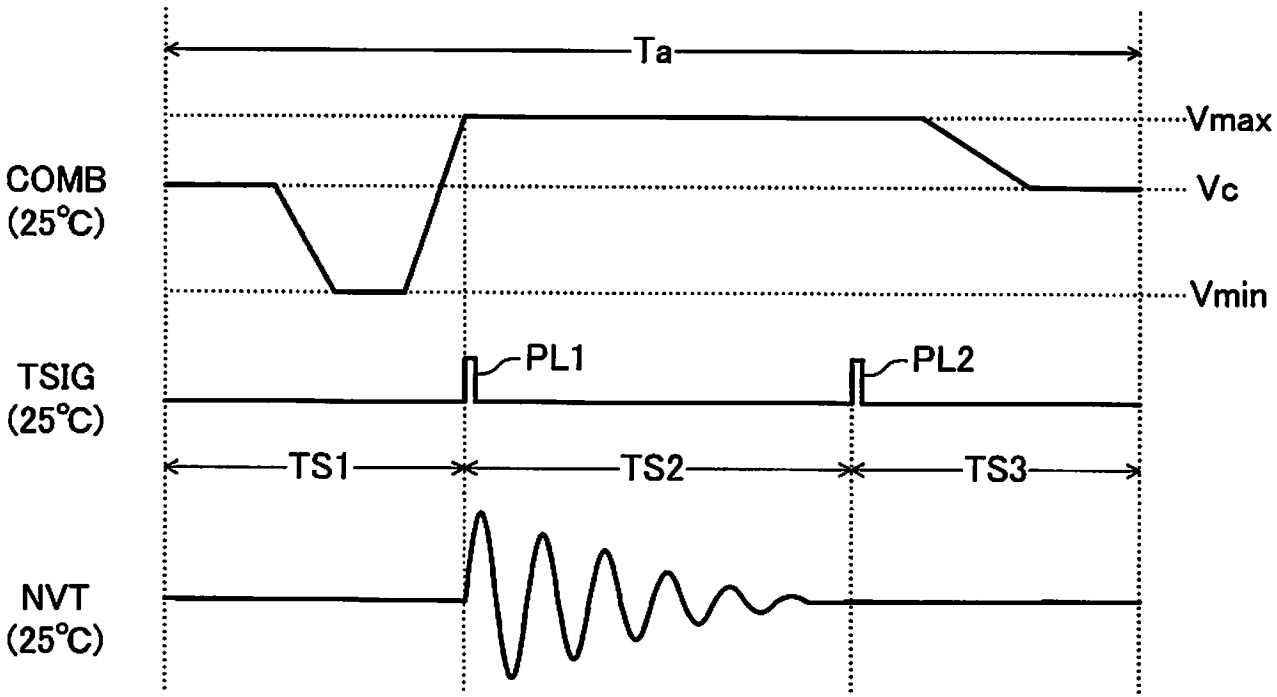
FIG. 14 is a diagram illustrating an example of waveforms of a drive signal, an inspection control signal, and a residual vibration signal according to a first embodiment.
Figure 15:
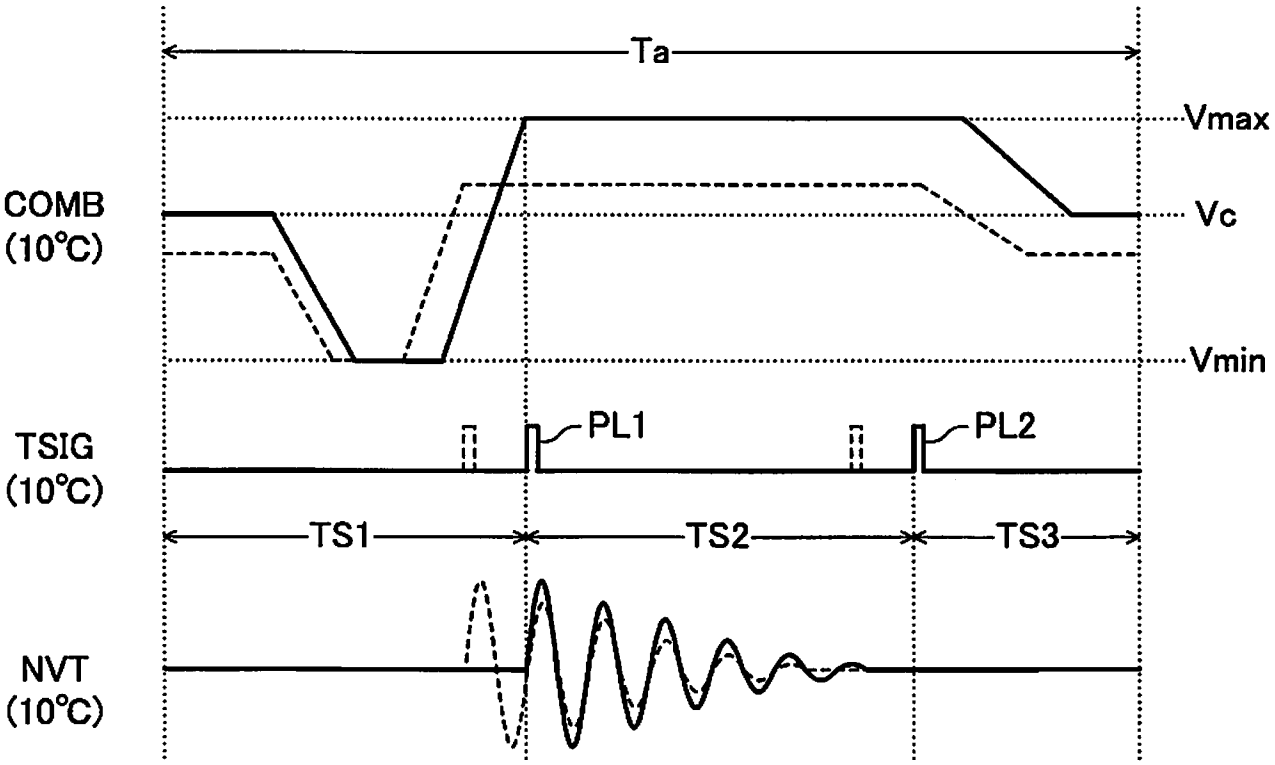
FIG. 15 is a diagram illustrating another example of the waveforms of the drive signal, the inspection control signal, and the residual vibration signal according to the first embodiment.
Figure 16:
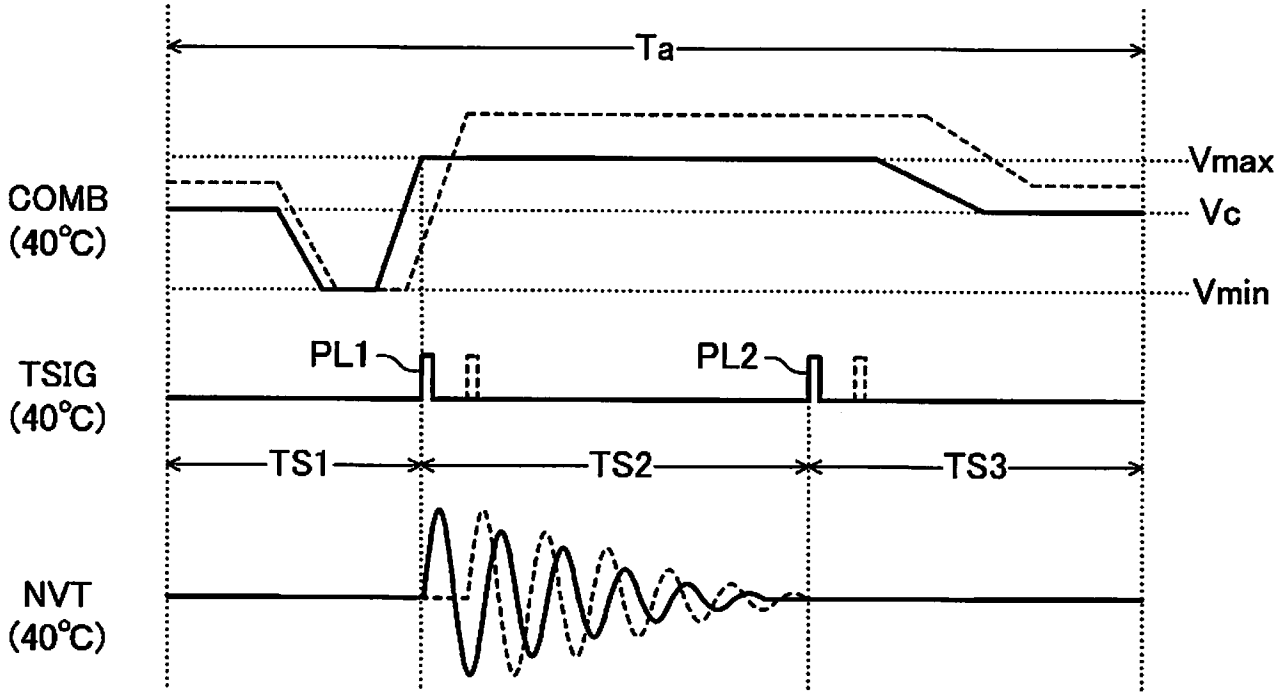
FIG. 16 is a diagram illustrating still another example of the waveforms of the drive signal, the inspection control signal, and the residual vibration signal according to the first embodiment.

FIGS. 14 to 16 are diagrams illustrating examples of the waveforms of the drive signal COMB, the inspection control signal TSIG, and the residual vibration signal NVT in the cycle Ta. FIG. 14 illustrates a case where the temperature of the ejection unit 600 is 25° C., FIG. 15 illustrates a case where the temperature of the ejection unit 600 is 10° C., and FIG. 16 illustrates a case where the temperature of the ejection unit 600 is 40° C. In FIGS. 15 and 16, waveforms (respective waveforms in FIG. 14) of the respective signals at 25° C. are denoted by dotted lines for comparison.

As illustrated in FIGS. 14 to 16, the drive signal COMB when the temperature is 40° C. (an example of a "first temperature") differs from the drive signal COMB when the temperature is 25° C. (an example of a "second temperature") lower than 40° C. In addition, the drive signal COMB when the temperature is 25° C. (another example of the "first temperature") differs from the drive signal COMB when the temperature is 10° C. (another example of the "second temperature") lower than 25° C.

Specifically, an amplitude (a potential difference between a maximum potential Vmax and a minimum potential Vmin) of the drive signal COMB when the temperature is 40° C. is smaller than an amplitude of the drive signal COMB when the temperature is 25° C. (see FIG. 16). In addition, the amplitude of the drive signal COMB when the temperature is 25° C. is smaller than the amplitude of the drive signal COMB when the temperature is 10° C. (see FIG. 15).

In the examples illustrated in FIGS. 14 to 16, the amplitude of the drive signal COMB changes depending on the temperature such that the residual vibrations in the ejection unit 600 are equal to each other when the temperatures are 10° C., 25° C., and 40° C. Here, the "equal" includes not only a case where the residual vibrations are accurately equal to each other, but also a case where the residual vibrations are substantially equal to each other, for example, a case where there is a difference as long as the same determination criterion is used for determination made by the determination unit 83.

In the examples of FIGS. 14 to 16, the minimum potential Vmin is constant such that the minimum potential Vmin is not lower than the offset voltage VBS, and the maximum potential Vmax changes depending on the temperature, and thereby the amplitude of the drive signal COMB changes.

Furthermore, the inspection control signal TSIG when the temperature is 40° C. differs from the inspection control signal TSIG when the temperature is 25° C. In addition, the inspection control signal TSIG when the temperature is 25° C. differs from the inspection control signal TSIG when the temperature is 10° C.

Specifically, an instruction (a rising edge of the first pulse PL1) to start detection of the residual vibration made by the inspection control signal TSIG when the temperature is 40° C. and an instruction (rising of the second pulse PL2) to end the detection are executed earlier than instructions to start and end the detection of the residual vibration made by the inspection control signal TSIG when the temperature is 25° C. In addition, the instructions to start and end the detection of the residual vibration made by the inspection control signal TSIG when the temperature is 25° C. are executed earlier than the indication to start and end the detection of the residual vibration made by the inspection control signal TSIG when the temperature is 10° C.

In the examples of FIGS. 14 to 16, the control unit 111 makes a rising edge of the first pulse PL1 coincide with the timing at which a rise of a potential of the drive signal COMB ends, and thereby, phases of the residual vibration signals NVT which uses the rising edge of the first pulse P11 as a reference when the temperature rises are 10° C., 25° C., and 40° C. are equalized. Accordingly, since the above-described time Tp1 (see FIG. 12) is equal regardless of the temperature, the threshold time Tth1 may be kept constant.

Furthermore, as described above, since the residual vibrations in the ejection unit 600 are equal when the temperatures are 10° C., 25° C., and 40° C., waveforms of the residual vibration signal NVT which uses the rising edge of the first pulse PL1 as a reference are equalized. Accordingly, since the amplitudes of the residual vibration signal NVT are equal in the time TP2 and a period from the time t1 to the time t2 regardless of the temperature, the threshold times Tth2 to Tth4 and the threshold potentials Vth1 to Vth3 may also be kept constant.

In FIGS. 14 to 16, only a case where the temperatures are 10° C., 25° C., and 40° C. is taken as an example, but actually, the control unit 111 corrects the drive signal COMB and the inspection control signal TSIG at other temperatures. For example, the control unit 111 may store table information indicating a relationship between a range of a value of the temperature signal VTEMP and timing of the drive data dB1 to dB4 and the inspection control signal TSIG in a storage unit (not illustrated), based on actually measured values at the time of evaluating a characteristic of the liquid ejecting apparatus 1, and may change the amplitudes of the drive data dB1 to dB4 and the timing of the inspection control signal TSIG, based on the table information and the value of the temperature signal VTEMP. An interval between the amplitudes of the drive data dB1 to dB4 or the temperatures at which the timing of the inspection control signal TSIG change may be appropriately selected in consideration of an influence on accuracy of determination made by the determination unit 83, and for example, may be an interval of 5° C.

In the examples of FIGS. 14 to 16, the rising edge of the first pulse PL1 coincides with the timing at which the rise of the potential of the drive signal COMB ends, but the rising edge of the first pulse PL1 may be synchronous to the timing at which the rise of the potential of the drive signal COMB ends, and there is no need to coincide with each other. For example, the time from the timing at which the rise of the potential of the drive signal COMB ends to the rising edge of the first pulse PL1 may be equalized regardless of the temperature.

1-8. Operational Effect

As described above, in the liquid ejecting apparatus 1 according to the first embodiment, the control unit 111 changes the drive data dB1 to dB4 such that the amplitude of the drive signal COMB (drive signal for generating the residual vibration) is reduced as the temperature increases, and thereby, even if the temperature changes, the amplitude of the residual vibration in the ejection unit 600 does not substantially change. In addition, the control unit 111 makes the timing of the first pulse PL1 (instruction to start the residual vibration) of the inspection control signal TSIG earlier as the temperature increases, and thereby, even if the temperature changes, a time difference between the timing at which the inspection circuit 80 starts to detect the residual vibration and the timing (that is, a first wave of the residual vibration signal NVT) at which the residual vibration starts in the ejection unit 600 does not substantially change. As a result, even if the temperature changes, the waveform of the residual vibration signal NVT does not substantially change when the first pulse PL1 of the inspection control signal TSIG is used as a reference, and thus, there is no need to change the threshold potentials Vth1 to Vth3 and the threshold times Tth1 to Tth4 depending on the temperature.

In addition, in the liquid ejecting apparatus 1 according to the first embodiment, the control unit 111 makes the timing of the second pulse PL2 (instruction to end the residual vibration) of the inspection control signal TSIG as the temperature increases, and thereby, even if the temperature changes, a period of detection of the residual vibration made by the inspection circuit 80 does not substantially change.

Thus, according to the liquid ejecting apparatus 1 of the first embodiment, it is possible to simplify an inspection sequence from the detection of the residual vibration made by the inspection circuit 80 to the determination of the ejection state of the ejection unit 600.

2. Second Embodiment

Hereinafter, in a liquid ejecting apparatus according to a second embodiment, the same reference numerals or symbols are attached to the same configuration element as in the first embodiment, description overlapping with the first embodiment will be omitted, and content different from the first embodiment will be mainly described.

The liquid ejecting apparatus 1 according to the second embodiment keeps the threshold times Tth1 to Tth4 and the threshold potentials Vth1 to Vth3 to be constant regardless of the temperature, and further makes it unnecessary to change the inspection control signal TSIG even if the temperature changes, thereby, further simplifying an inspection sequence. Specifically, in the cycle Ta, the control unit 111 corrects the inspection control signal TSIG depending on the temperature such that not only a magnitude of the residual vibration generated in the inspection target ejection unit 600 but also the timing at which the residual vibration occurs are equalized regardless of the temperature.

Figure 17:
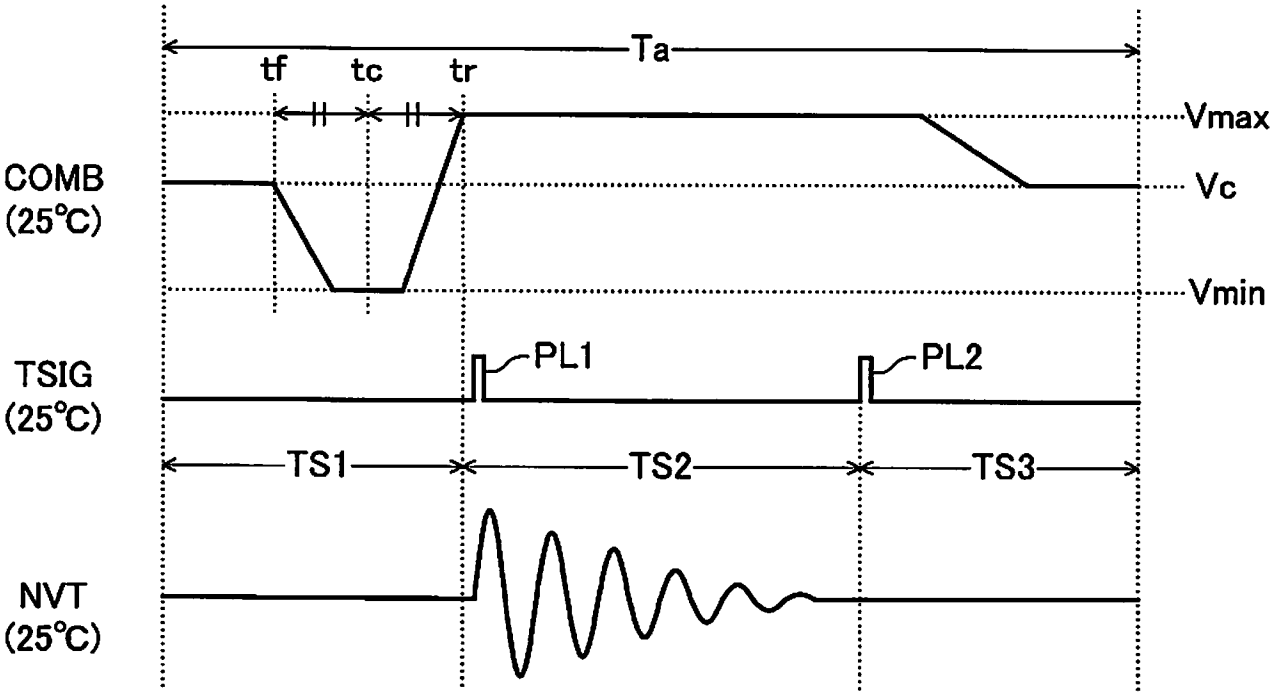
FIG. 17 is a diagram illustrating an example of waveforms of a drive signal, an inspection control signal, and a residual vibration signal according to a second embodiment.
Figure 18:
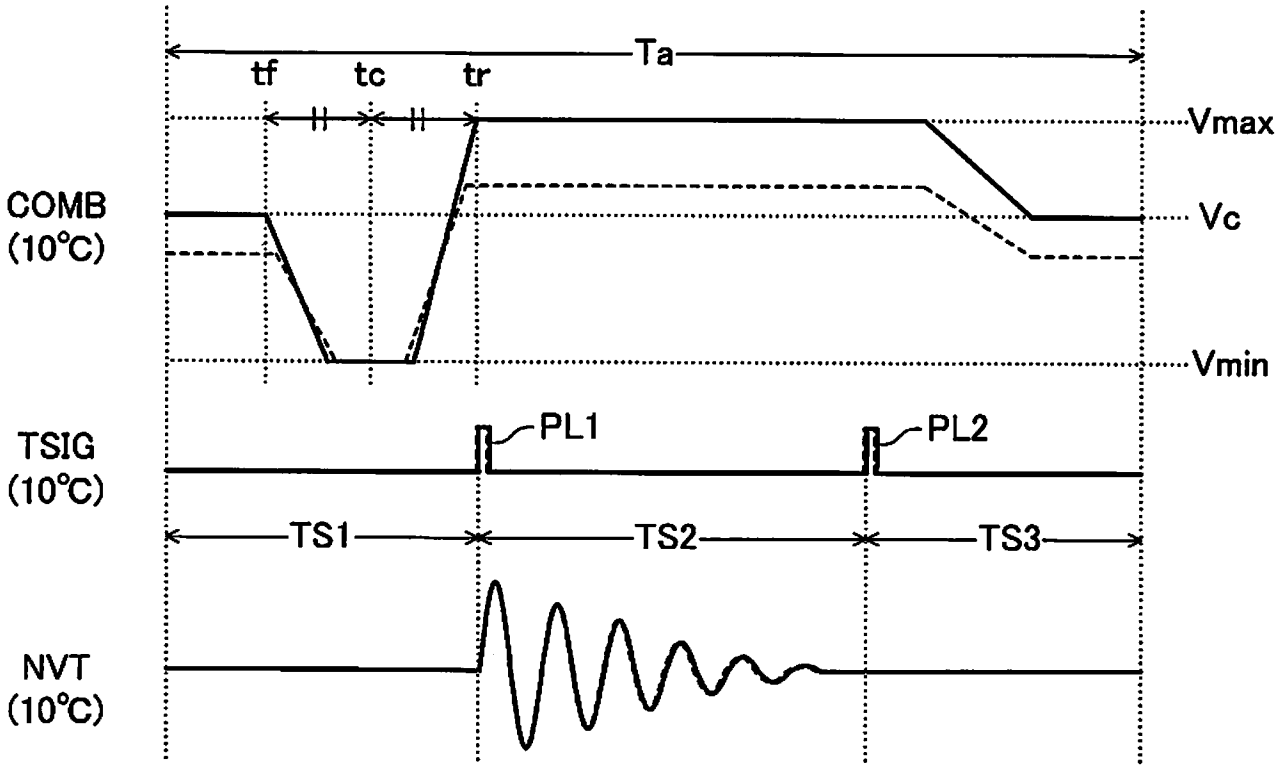
FIG. 18 is a view illustrating another example of the waveforms of the drive signal, the inspection control signal, and the residual vibration signal according to the second embodiment.
Figure 19:
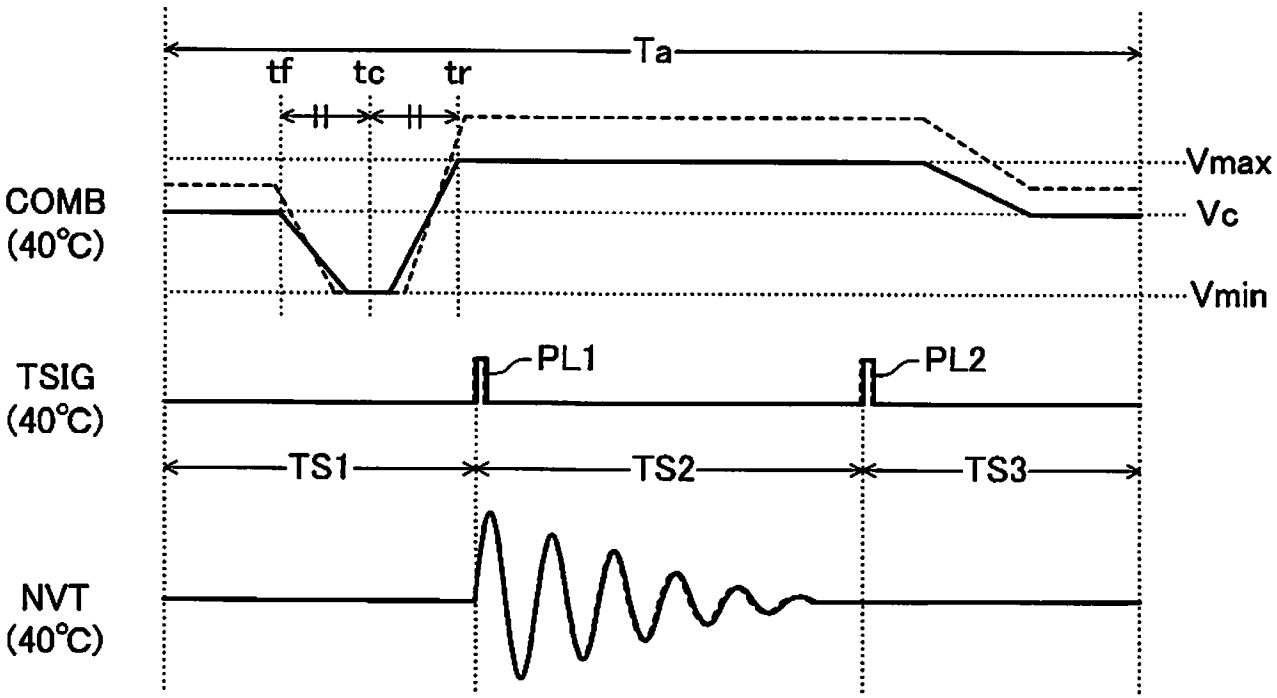
FIG. 19 is a view illustrating still another example of the waveforms of the drive signal, the inspection control signal, and the residual vibration signal according to the second embodiment.

FIGS. 17 to 19 are diagrams illustrating examples of waveforms of the drive signal COMB, the inspection control signal TSIG, and the residual vibration signal NVT in the cycle Ta in the second embodiment. FIG. 17 illustrates a case where the temperature of the ejection unit 600 is 25° C., FIG. 18 illustrates a case where the temperature of the ejection unit 600 is 10° C., and FIG. 19 illustrates a case where the temperature of the ejection unit 600 is 40° C. In FIG. 18 and FIG. 19, the waveforms of the respective signals (respective waveform in FIG. 17) at 25° C. are denoted by dotted lines for comparison.

As illustrated in FIGS. 17 to 19, the drive signal COMB when the temperature is 40° C. differs from the drive signal COMB when the temperature is 25° C. In addition, the drive signal COMB when the temperature is 25° C. differs from the drive signal COMB when the temperature is 10° C.

Specifically, an amplitude of the drive signal COMB (a potential difference between the maximum potential Vmax and the minimum potential Vmin) when the temperature is 40° C. is smaller than an amplitude of the drive signal COMB when the temperature is 25° C. (see FIG. 19). In addition, the amplitude of the drive signal COMB when the temperature is 25° C. is smaller than an amplitude of the drive signal COMB when the temperature is 10° C. (see FIG. 18). In the period TS1, a rise and a fall of a potential of the drive signal COMB when the temperature is 40° C. is gentler than a rise and a fall of a potential of the drive signal COMB when the temperature is 25° C. (see FIG. 19). In addition, the rise and the fall of the potential of the drive signal COMB when the temperature of the ejection unit 600 is 25° C. is gentler than a rise and a fall of a potential of the drive signal COMB when the temperature is 10° C. (see FIG. 18). Furthermore, when the time at which the period TS1 starts is set to zero, the time when the potential of the drive signal COMB starts to fall is set to tf, the time when a rise of the potential of the drive signal COMB ends is set to tr, and the time that becomes (tf+tr)/2 is set to tc, The times tc when the temperature are 10° C., and 25° C., and 40° C. are equalized.

In the examples of FIGS. 17 to 19, by correcting the drive signal COMB in this way, the residual vibrations in the ejection unit 600 when the temperature is 10° C., 25° C., and 40° C. are equalized by including the start timing, and the waveforms and the phases of the residual vibration signal NVT are also equalized. Accordingly, when the temperature is 10° C., 25° C., and 40° C., the timings of the instruction (rising edge of the first pulse PL1) to start detection of the residual vibration by the inspection control signal TSIG are the same as each other, and the threshold times Tth1 to Tth4 and the threshold potentials Vth1 to Vth3 may be kept constant regardless of the temperature.

In FIGS. 17 to 19, only a case where the temperature is 10° C., 25° C., and 40° C. is taken as an example, but actually the control unit 111 corrects the drive signal COMB even at other temperatures. For example, the control unit 111 may store table information indicating a relationship between a range of a value of the temperature signal VTEMP and the drive data dB1 to dB4 in a storage unit (not illustrated), based on the actually measured value at the time of evaluating a characteristic of the liquid ejecting apparatus 1, and may change the drive data dB1 to dB4, based on the table information and a value of the temperature signal VTEMP.

As described above, in the liquid ejecting apparatus 1 according to the second embodiment, the control unit 111 changes the drive data dB1 to dB4 such that an amplitude of the drive signal COMB (drive signal for generating the residual vibration) decreases as the temperature increases and the time tc coincides even if the temperature changes, and thereby, even if the temperature changes, an amplitude and a phase of the residual vibration in the ejection unit 600 does not substantially change. In addition, the control unit 111 makes timing of the first pulse PL1 (instruction to start the residual vibration) of the inspection control signal TSIG earlier as the temperature increases, and thereby, even if the temperature changes, a time difference between the timing at which the inspection circuit 80 start to detect the residual vibration and the timing (that is, a first wave of the residual vibration signal NVT) at which the residual vibration starts in the ejection unit 600 does not substantially change. As a result, even if the temperature changes, the waveform of the residual vibration signal NVT in the cycle Ta does not substantially change, and thus, there is no need to change the threshold potentials Vth1 to Vth3, the threshold times Tth1 to Tth4, and the inspection control signal TSIG.

Thus, according to the liquid ejecting apparatus 1 of the second embodiment, it is possible to simplify an inspection sequence from the detection of the residual vibration by the inspection circuit 80 to determination of the ejection state of the ejection unit 600.

3. Third Embodiment

Hereinafter, in a liquid ejecting apparatus according to a third embodiment, the same reference numerals or symbols are attached to the same configuration elements as in the first embodiment, description overlapping with the first embodiment will be omitted, and content different from the first embodiment will be mainly described.

In the liquid ejecting apparatus 1 according to the third embodiment, the control unit 111 corrects the inspection control signal TSIG depending on a temperature, but does not correct the drive signal COMB. That is, the drive signal COMB has a constant waveform regardless of the temperature. Accordingly, the higher the temperature is, the larger the amplitude of the residual vibration signal NVT is, and the lower the temperature is, the smaller the amplitude of the residual vibration signal NVT is. If the amplitude of the drive signal COMB is too small, the amplitude of the residual vibration signal NVT when the temperature is low is reduced too much, and a determination accuracy is reduced by the determination unit 83, and thus, the drive signal COMB needs to have a certain amplitude. As a result, there is a possibility that an amplitude of the first wave increases too much and the residual vibration signal NVT at the time of a high temperature is saturated by an upper limit voltage or a lower limit voltage of an output range of the waveform shaping unit 81. That is, since the first wave of the residual vibration signal NVT is distorted, a measurement accuracy of the time Tp1 corresponding to the phase of the residual vibration by the measurement unit 82 may be reduced in particular. Therefore, in a case where the temperature (temperature of the head 21 indicated by the temperature signal VTEMP) of the ejection unit 600 is higher than or equal to a predetermined temperature, the control unit 111 delays an instruction (a rising edge of the first pulse PL1) to start detection by the inspection control signal TSIG to a point after the first wave of the residual vibration signal NVT.

Figure 20:
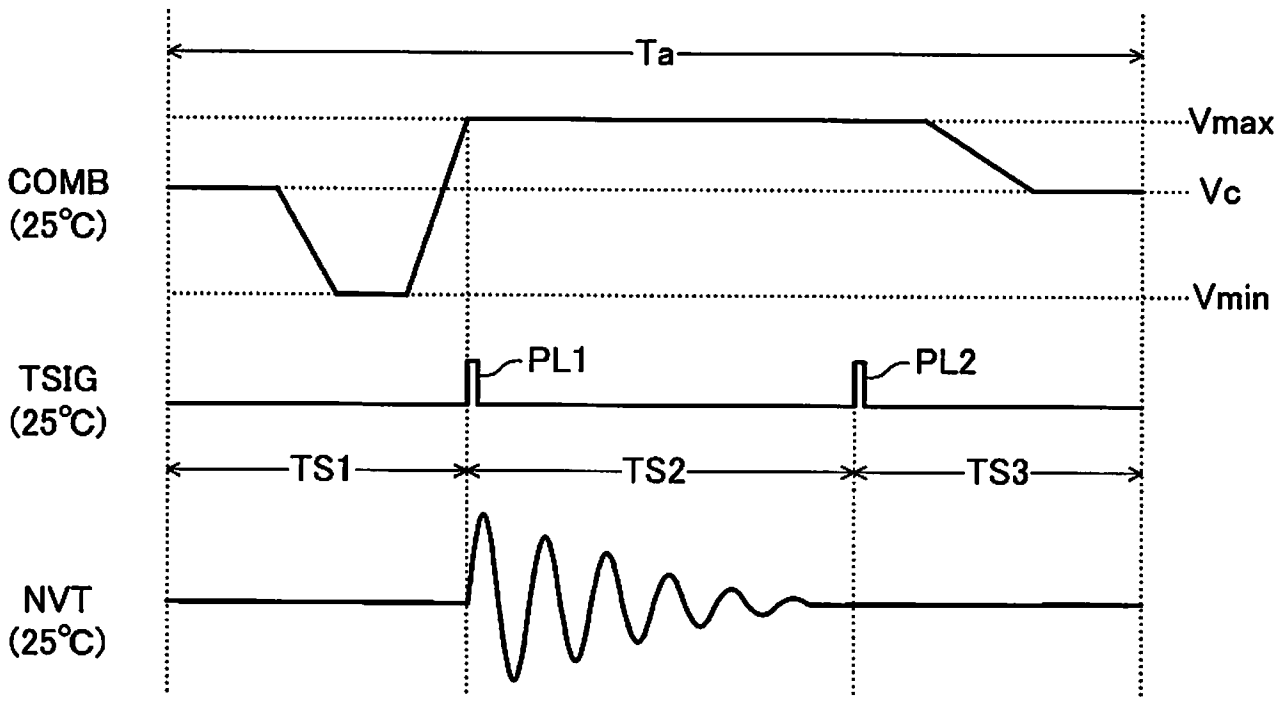
FIG. 20 is a diagram illustrating an example of waveforms of a drive signal, an inspection control signal, and a residual vibration signal according to a third embodiment.
Figure 21:
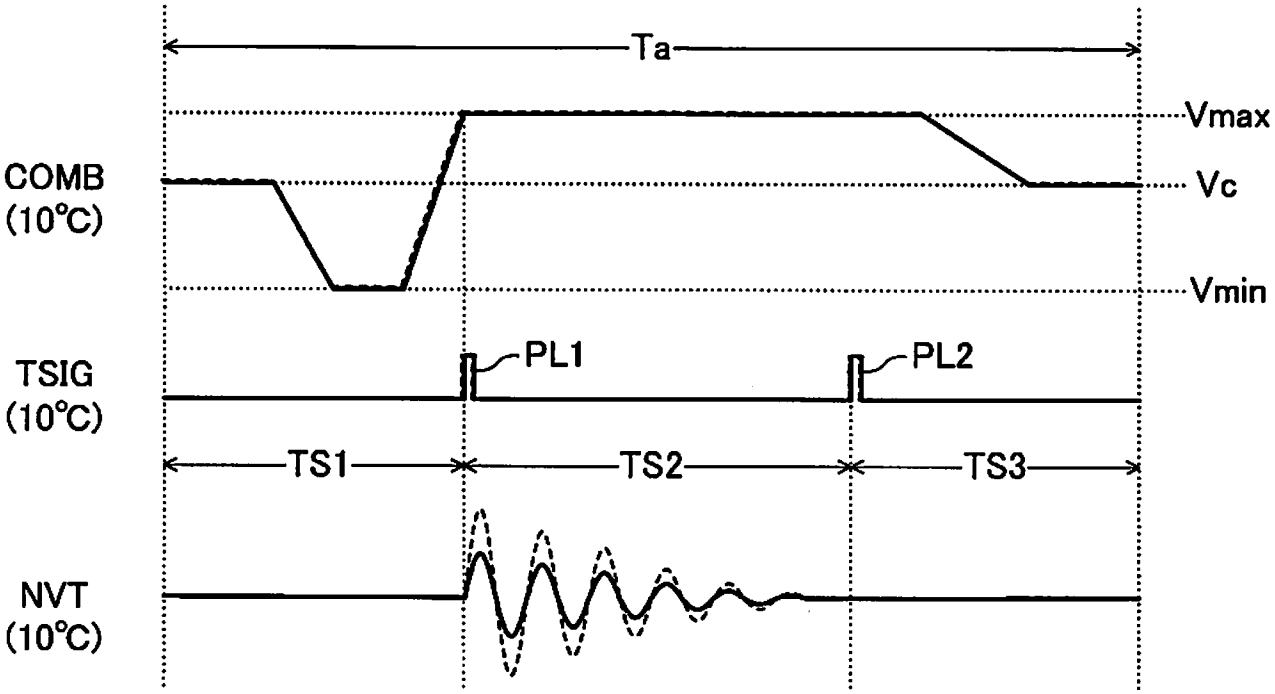
FIG. 21 is a diagram illustrating another example of the waveforms of the drive signal, inspection control signal, and the residual vibration signal according to the third embodiment.
Figure 22:
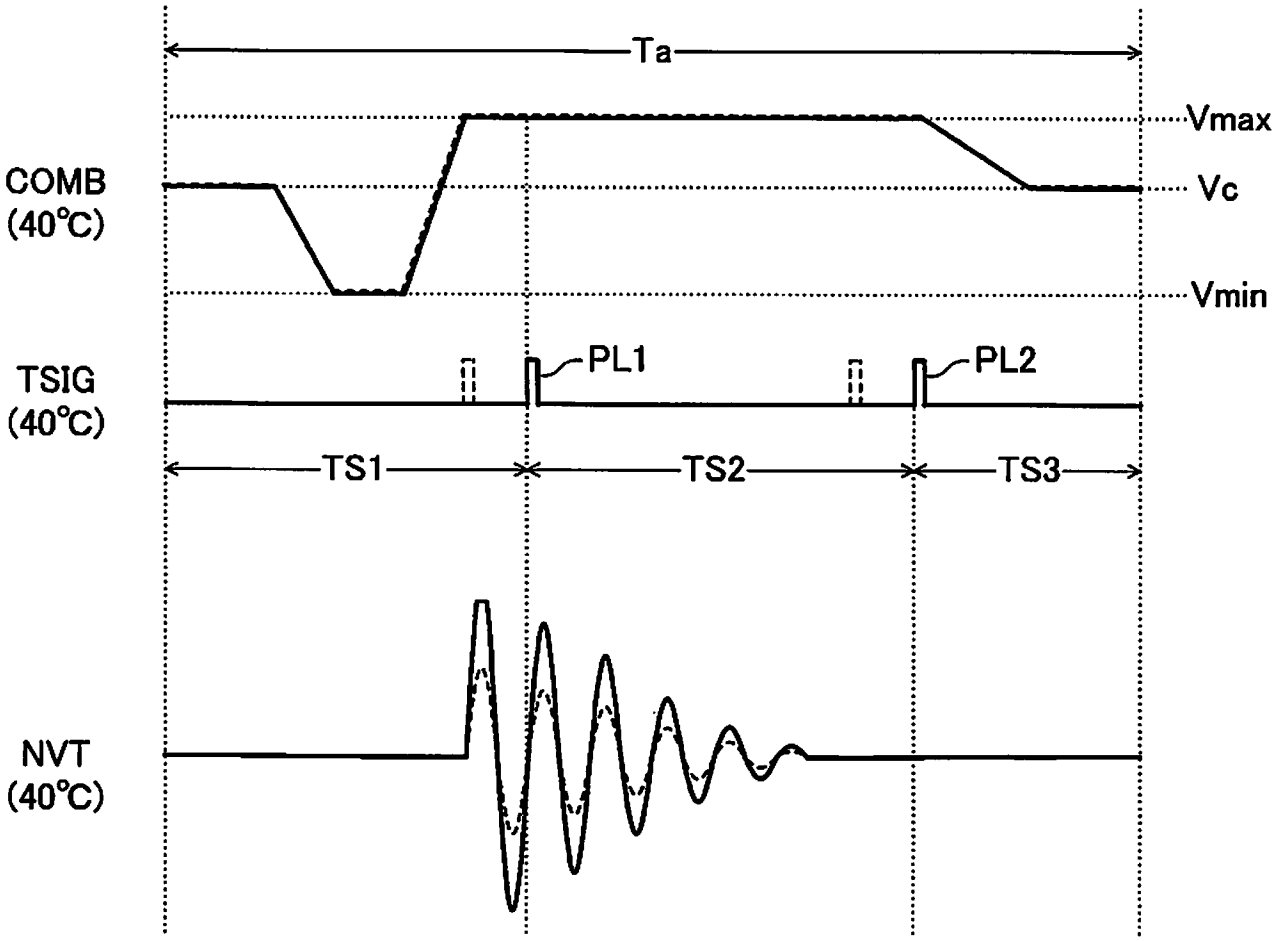
FIG. 22 is a diagram illustrating still another example of the waveforms of the drive signal, the inspection control signal, and the residual vibration signal according to the third embodiment.

FIGS. 20 to 22 are diagrams illustrating examples of waveforms of the drive signal COMB, the inspection control signal TSIG, and the residual vibration signal NVT in the cycle Ta, in the third embodiment. FIG. 20 illustrates a case where the temperature of the ejection unit 600 is 25° C., FIG. 21 illustrates a case where the temperature of the ejection unit 600 is 10° C., and FIG. 22 illustrates a case where the temperature of the ejection unit 600 is 40° C. In FIGS. 21 and 22, waveforms (respective waveforms in FIG. 20) of the respective signals at 25° C. are denoted by dotted lines for comparison.

As illustrated in FIGS. 20 to 22, the drive signal COMB when the temperature is 25° C. is equal to the drive signal COMB when the temperature is 10° C. In addition, the drive signal COMB when the temperature is 40° C. is equal to the drive signal COMB when the temperature is 25° C. Accordingly, the residual vibration when the temperature is 25° C. is larger than the residual vibration when the temperature is 10° C., and the residual vibration when the temperature is 40° C. is higher than the residual vibration when the temperature is 25° C. As a result, as illustrated in FIG. 21, the amplitude of the residual vibration signal NVT when the temperature is 25° C. is larger than the amplitude of the residual vibration signal NVT when the temperature is 10° C. In addition, as illustrated in FIG. 22, the residual vibration signal NVT when the temperature is 40° C. is larger in amplitude than the residual vibration signal NVT when the temperature is 25° C., and the first wave is distorted.

Accordingly, as illustrated in FIG. 22, the inspection control signal TSIG when the temperature is 40° C. is different from the inspection control signal TSIG when the temperature is 25° C. Specifically, an instruction (rising edge of the first pulse PL1) to start detection of the residual vibration by the inspection control signal TSIG when the temperature is 40° C. and the instruction (rising edge of the second pulse PL2) to end the detection is performed later than the instruction to start and end the detection of the residual vibration by the inspection control signal TSIG when the temperature is 25° C. That is, the first pulse PL1 and the second pulse PL2 of the inspection control signal TSIG when the temperature is 40° C. are shifted such that the first pulse PL1 is delayed behind the first wave of the residual vibration signal NVT.

As described above, in the present embodiment, in a case where the temperature (temperature of the head 21 indicated by the temperature signal VTEMP) of the ejection unit 600 is higher than or equal to a predetermined temperature, the first pulse PL1 of the inspection control signal TSIG is delayed behind the first pulse of the residual vibration signal NVT, and thus, there is no need to change processing of the measurement unit 82 depending on the temperature. The predetermined temperature may be appropriately set, for example, by actually measuring the residual vibration signal NVT while changing the temperature when a characteristic of the liquid ejecting apparatus 1 is evaluated. In addition, information on the shift amount of the first pulse PL1 and the second pulse PL2 of the inspection control signal TSIG is stored in a storage unit (not illustrated), based on the actually measured value of the residual vibration signal NVT, and the control unit 111 may shift the first pulse PL1 and the second pulse PL2, based on the information on the shift amount.

Figure 23:
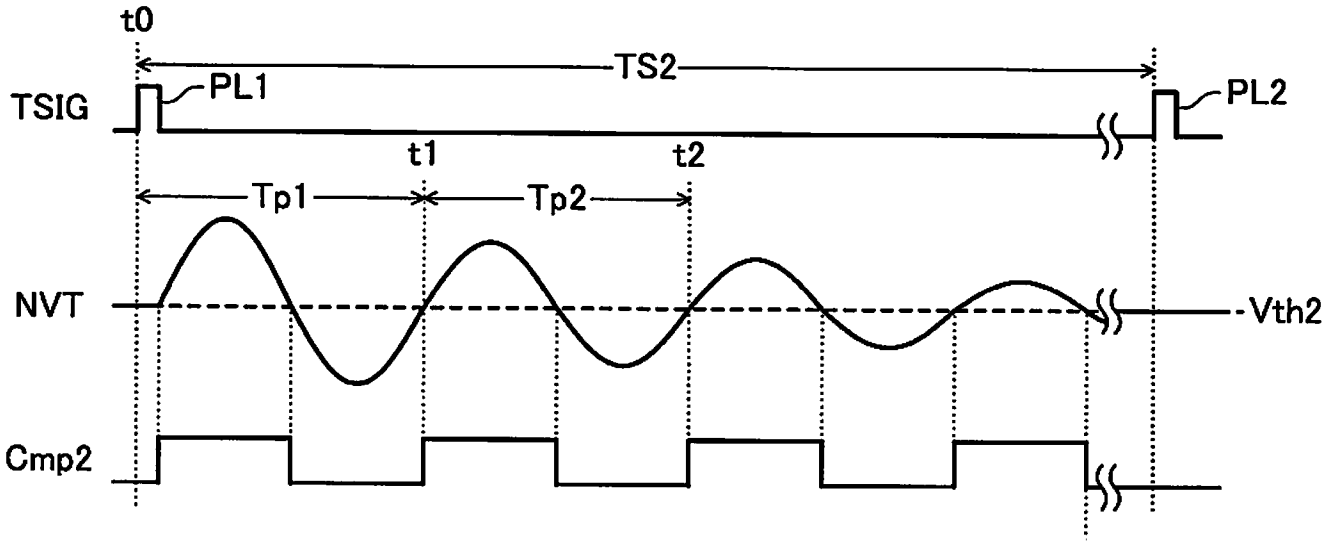
FIG. 23 is a diagram illustrating an operation of a measurement unit according to the third embodiment.
Figure 24:
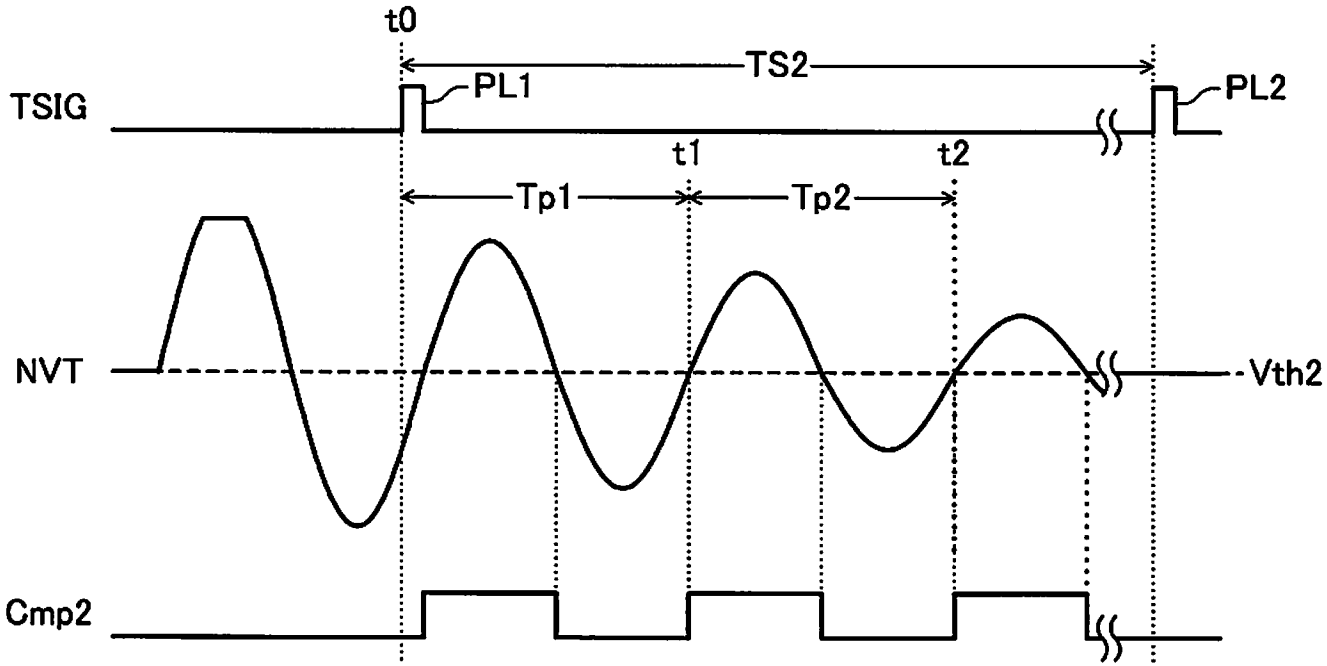
FIG. 24 is a diagram illustrating the operation of the measurement unit according to the third embodiment.

FIGS. 23 and 24 are timing charts illustrating an operation of the measurement unit 82 according to the third embodiment. FIG. 23 illustrates a case (for example, the case of FIG. 20 or FIG. 21) where the temperature of the ejection unit 600 is lower than a predetermined temperature, and the first wave of the residual vibration signal NVT is not distorted. FIG. 24 illustrates a case (for example, the case of FIG. 22) where the temperature of the ejection unit 600 is higher than or equal to the predetermined temperature, and the first wave of the residual vibration signal NVT is distorted.

As illustrated in FIGS. 23 and 24, if the period TS2 starts and supplying the residual vibration signal NVT starts, the measurement unit 82 compares the residual vibration signal NVT with the threshold potential Vth2 which is a potential of an amplitude center level of the residual vibration signal NVT. Then, the measurement unit 82 generates the comparison signal Cmp2 which goes to a high level in a case where the potential of the residual vibration signal NVT becomes the threshold potential Vth2.

Then, the measurement unit 82 measures the time Tp1 from the start time t0 of the period TS2 to the time t1 when the comparison signal Cmp2 first falls to a low level and then rises to a high level. In addition, the measurement unit 82 measures the time Tp2 from the time t1 to the time t2 when the comparison signal Cmp2 falls to the next low level and then rises to the high level. However, since the amplitude of the residual vibration signal NVT largely changes depending on the temperature, in order for the measurement unit 82 to output the amplitude determination value Ap described in the first embodiment, the threshold potentials Vth1 and Vth3 has to be changed depending on the temperature, which hinders simplification of an inspection sequence. Therefore, in the present embodiment, the measurement unit 82 does not output the amplitude determination value Ap, and thus, the threshold potentials Vth1 and Vth3 are not required.

That is, the determination unit 83 determines an ejection state (presence or absence of an ejection abnormality, a cause of the ejection abnormality, and the like) of the inspection target ejection unit 600, based on the time Tp1 corresponding to a phase of the residual vibration and the time Tp2 corresponding to a cycle of the residual vibration. For example, the determination unit 83 may determine that the amplitude determination value Ap is constantly "1" in the determination logic illustrated in FIG. 13.

In the example of FIG. 23, the measurement unit 82 measures the time from the rising edge of the first pulse PL1 of the inspection control signal TSIG to the start of the second wave of the residual vibration signal NVT as the time Tp1. In contrast to this, in the example of FIG. 24, the measurement unit 82 measures the time from the rise of the first pulse PL1 of the inspection control signal TSIG to the start of the third wave of the residual vibration signal NVT as the time Tp1. In the examples of FIGS. 23 and 24, in order that the times Tp1 are equal to each other in a case where the temperature of the ejection unit 600 is higher than or equal to a predetermined temperature and in a case where the temperature of the ejection unit 600 is lower than the predetermined temperature, the timing of the first pulse PL1 and the second pulse PL2 of the inspection control signal TSIG is corrected in a case where the temperature of the ejection unit 600 is higher than or equal to the predetermined temperature. Accordingly, the threshold time Tth1 may be kept constant regardless of the temperature. In the example of FIG. 23, the measurement unit 82 measures a cycle of the second wave of the residual vibration signal NVT as the time Tp2. In contrast to this, in the example of FIG. 24, the measurement unit 82 measures a cycle of the third wave of the residual vibration signal NVT as the time Tp2. The residual vibration generated by the ejection unit 600 is attenuated with the lapse of time, but a vibration cycle hardly changes, and thus, cycles of the first wave and the second wave of the residual vibration signal NVT may be considered to be the same. Accordingly, the threshold times Tth2 to Tth4 may also be kept constant regardless of the temperature.

In the examples of FIGS. 20 to 24, the phases of the residual vibration signals NVT are the same regardless of the temperature, but in a case where the phase of the residual vibration signal NVT changes depending on the temperature, the control unit 111 may change (correct) the timing of the first pulse PL1 and the second pulse PL2 of the inspection control signal TSIG in accordance with a value of the temperature signal VTEMP such that the times Tp1 are equal to each other regardless of the temperature. For example, table information indicating a relationship between a range of the value of the temperature signal VTEMP and timing of the inspection control signal TSIG is stored in a storage unit, based on the actually measured value when a characteristic of the liquid ejecting apparatus 1 is evaluated, and the control unit 111 may change the timing of the inspection control signal TSIG, based on the table information and the value of the temperature signal VTEMP.

As described above, in the liquid ejecting apparatus 1 according to the third embodiment, in a case where the temperature of the ejection unit 600 is higher than or equal to a predetermined temperature, the control unit 111 delays the timing of the first pulse PL1 (instruction to start the residual vibration) of the inspection control signal TSIG to a point behind the first wave of the residual vibration signal NVT, and thus, the inspection circuit 80 can detect the residual vibration with respect to the second and subsequent waves without distortion of the residual vibration signal NVT. A time difference between the timing of the first pulse PL1 of the inspection control signal TSIG and the timing of the second wave of the residual vibration signal NVT when the temperature of the ejection unit 600 is higher than or equal to the predetermined temperature is equal to a time difference between the timing of the first pulse PL1 of the inspection control signal TSIG and the timing of the first wave of the residual vibration signal NVT when the temperature of the ejection unit 600 is lower than the predetermined temperature. In addition, cycles of the first wave and the second wave of the residual vibration signal NVT are the same.

In addition, in the liquid ejecting apparatus 1 according to the third embodiment, in a case where the temperature of the ejection unit 600 is higher than or equal to the predetermined temperature, the timing of the second pulse PL2 (instruction to end the residual vibration) of the inspection control signal TSIG is delayed, and thereby, periods of detection of the residual vibration made by the inspection circuit 80 are equal to each other when the temperature of the ejection unit 600 is lower than the predetermined temperature and is higher than or equal to the predetermined temperature.

Thus, according to the liquid ejecting apparatus 1 of the third embodiment, it is possible to simplify an inspection sequence from detection of the residual vibration made by the inspection circuit 80 to determination of the ejection state of the ejection unit 600.

4. Modified Example

In the respective embodiments described above, the inspection circuit 80 is provided in the head unit 20, but at least a part of the inspection circuit 80 may be provided in the control substrate 100. For example, the determination unit 83 may be provided in the control substrate 100.

In the respective embodiments described above, the determination unit 83 of the inspection circuit 80 determines an ejection state of the inspection target ejection unit 600, but the inspection circuit 80 may output the residual vibration signal NVT to the control unit 111, and the control unit 111 may make the determination, based on the residual vibration signal NVT.

In the respective embodiments described above, it is described that the ink is not ejected even if the inspection target ejection unit 600 is driven by the drive signal COMB, but ink may be ejected from the ejection unit 600 by increasing an amplitude of the drive signal COMB. Since the amplitude of the residual vibration increases as the amplitude of the drive signal COMB increases, a determination accuracy increases. In this case, for example, detection processing of the residual vibration is performed in an inspection mode in which print processing is not performed.

In the respective embodiments described above, the control substrate 100 and the head unit 20 are connected by one cable 190, but may be connected by a plurality of cables. In addition, various signals may be wirelessly transmitted from the control substrate 100 to the head unit 20. That is, the control substrate 100 and the head unit 20 may not be connected by the cable 190.

In the respective embodiments described above, the drive circuit 50 is provided in the control substrate 100, but may be provided in the head unit 20.

In addition, in the embodiment described above, a part or all of the waveforms of the drive signal COMA is selected to generate the drive signals VOUT corresponding to a "large dot", a "medium dot", a "small dot", and a "non-record", and a part of the drive signal COMB is selected to generate the drive signal VOUT corresponding to an "inspection", but the method of generating the drive signal to be applied to each piezoelectric element 60 is not limited thereto, and various methods can be adopted. For example, waveforms of a plurality of drive signals may be combined to generate the drive signals corresponding to the "large dot", the "medium dot", "small dot", the "non-record", and the inspection".

In the embodiments described above, a serial scan type (serial print type) ink jet printer which prints an image on a print medium by moving the head is used as an example of the liquid ejecting apparatus, but, the invention can also be adopted to a line head type ink jet printer which prints an image on a print medium without moving the head.

The present embodiment and the modification examples are described above, but the invention is not limited to the embodiments or the modification examples, and can be implemented in various modes without departing from the gist thereof. For example, it is also possible to appropriately combine the respective embodiments and the respective modification examples described above.

The invention includes substantially the same configuration (for example, a configuration having the same function, method and result, or a configuration having the same object and effect) as the configuration described in the embodiments. In addition, the invention includes a configuration in which a non-essential part of the configuration described in the embodiment is replaced. In addition, the invention includes a configuration that achieves the same operation effect as the configuration described in the embodiment, or a configuration that can achieve the same object. In addition, the invention includes a configuration in which a publicly known technique is added to a configuration described in the embodiment.

What is claimed is:

1. A liquid ejecting apparatus comprising:

an ejection unit that ejects a liquid by a piezoelectric element being driven;

a drive signal generation unit that generates a drive signal that drives the piezoelectric element;

a residual vibration detection unit that detects a residual vibration of the ejection unit after the drive signal is applied to the piezoelectric element; and an inspection control signal generation unit that generates an inspection control signal that instructs start and end of detection of the residual vibration by the residual vibration detection unit, wherein the inspection control signal when a temperature of the ejection unit is a first temperature differs from the inspection control signal when the temperature of the ejection unit is a second temperature lower than the first temperature, and wherein an instruction to start detection by the inspection control signal when the temperature of the ejection unit is the first temperature is executed earlier than an instruction to start detection by the inspection control signal when the temperature of the ejection unit is the second temperature, and an instruction to end the detection by the inspection control signal when the temperature of the ejection unit is the first temperature is executed earlier than an instruction to end the detection by the inspection control signal when the temperature of the ejection unit is the second temperature.

2. The liquid ejecting apparatus according to claim 1, wherein the residual vibration when the temperature of the ejection unit is the first temperature is equal to the residual vibration when the temperature of the ejection unit is the second temperature.

3. A liquid ejecting apparatus comprising:

an ejection unit that ejects a liquid by a piezoelectric element being driven;

a drive signal generation unit that generates a drive signal that drives the piezoelectric element;

a residual vibration detection unit that detects a residual vibration of the ejection unit after the drive signal is applied to the piezoelectric element; and an inspection control signal generation unit that generates an inspection control signal that instructs start of detection of the residual vibration by the residual vibration detection unit, wherein the drive signal when a temperature of the ejection unit is a first temperature differs from the drive signal when the temperature of the ejection unit is a second temperature lower than the first temperature, and wherein the drive signal when the temperature of the ejection unit is the first temperature falls to a predetermined potential and rises from the predetermined potential more gently than the drive signal when the temperature of the ejection unit is the second temperature, while a time tc when the temperature of the ejection unit is the first temperature is equal to a time tc when the temperature of the ejection unit is the second temperature, the time tc when the temperature of the ejection unit is the first temperature is obtained by a formula (tf+tr)/2 wherein tf is a time when a potential of the drive signal when the temperature of the ejection unit is the first temperature starts to fall to the predetermined potential and tr is a time when a rise of the potential of the drive signal when the temperature of the ejection unit is the first temperature from the predetermined potential ends, and the time tc when the temperature of the ejection unit is the second temperature is obtained by the formula (tf+tr)/2 wherein tf is a time when a potential of the drive signal when the temperature of the ejection unit is the second temperature starts to fall to the predetermined potential and tr is a time when a rise of the potential of the drive signal when the temperature of the ejection unit is the second temperature from the predetermined potential ends.

4. The liquid ejecting apparatus according to claim 3, wherein an amplitude of the drive signal when the temperature of the ejection unit is the first temperature is smaller than an amplitude of the drive signal when the temperature of the ejection unit is the second temperature.

5. The liquid ejecting apparatus according to claim 3, wherein an instruction to start detection by the inspection control signal when the temperature of the ejection unit is the first temperature is executed earlier than an instruction to start detection by the inspection control signal when the temperature of the ejection unit is the second temperature.

6. The liquid ejecting apparatus according to claim 5, wherein the inspection control signal further instructs end of the detection of the residual vibration, and wherein an instruction to end the detection by the inspection control signal when the temperature of the ejection unit is the first temperature is executed earlier than an instruction to end the detection by the inspection control signal when the temperature of the ejection unit is the second temperature.

7. A liquid ejecting apparatus comprising:

an ejection unit that ejects a liquid by a piezoelectric element being driven;

a drive signal generation unit that generates a drive signal that drives the piezoelectric element;

a residual vibration detection unit that detects a residual vibration of the ejection unit after the drive signal is applied to the piezoelectric element; and an inspection control signal generation unit that generates an inspection control signal that instructs start of detection of the residual vibration by the residual vibration detection unit, wherein the inspection control signal when a temperature of the ejection unit is a first temperature differs from the inspection control signal when the temperature of the ejection unit is a second temperature lower than the first temperature, and wherein the drive signal when the temperature of the ejection unit is the first temperature is the same as the drive signal when the temperature of the ejection unit is the second temperature, and wherein an instruction to start detection by the inspection control signal when the temperature of the ejection unit is the first temperature is executed later than an instruction to start detection by the inspection control signal when the temperature of the ejection unit is the second temperature.

8. The liquid ejecting apparatus according to claim 7, wherein the inspection control signal further instructs end of the detection of the residual vibration, and wherein the instruction to end the detection by the inspection control signal when the temperature of the ejection unit is the first temperature is executed later than the instruction to end the detection by the inspection control signal when the temperature of the ejection unit is the second temperature.

* * * * *